US011679919B2

(12) United States Patent
Hermanson

(10) Patent No.: US 11,679,919 B2
(45) Date of Patent: Jun. 20, 2023

(54) METHOD OF PACKING AN OBJECT IN A SHIPPING BOX

(71) Applicant: Terry Hermanson, New York, NY (US)

(72) Inventor: Terry Hermanson, New York, NY (US)

(73) Assignee: Terry Hermanson, New York, NY (US)

( * ) Notice: Subject to any disclaimer, the term of this patent is extended or adjusted under 35 U.S.C. 154(b) by 0 days.

(21) Appl. No.: 17/738,150

(22) Filed: May 6, 2022

(65) Prior Publication Data

US 2022/0355990 A1 Nov. 10, 2022

Related U.S. Application Data

(60) Provisional application No. 63/185,124, filed on May 6, 2021, provisional application No. 63/191,088, filed (Continued)

(51) Int. Cl.
*B65B 55/20* (2006.01)
*B65B 5/04* (2006.01)

(Continued)

(52) U.S. Cl.
CPC ..... *B65D 65/403* (2013.01); *B65B 5/04* (2013.01); *B65B 55/20* (2013.01); *B65D 81/051* (2013.01); *B65D 81/107* (2013.01); *B65D 81/127* (2013.01)

(58) Field of Classification Search
CPC combination set(s) only.
See application file for complete search history.

(56) References Cited

U.S. PATENT DOCUMENTS 1,189,140 A 6/1916 Lane
2,629,698 A * 2/1953 Sterling ..... C08J 9/0061 527/303

(Continued)

FOREIGN PATENT DOCUMENTS

DE 40 25 257 C2 9/1992
DE 42 25 143 A1 2/1994

(Continued)

OTHER PUBLICATIONS

Comprehensive Guide to cushioning and void fill for shipping packaging, Internet Archive of https://www.ecoenclose.com/Definitive-Guide-to-Void-Fill-and-Cushioning/ (captured Sep. 18, 2019), available at https://web.archive.org/web/20190918180012/https://www.ecoenclose.com/Definitive-Guide-to-Void-Fill-and-Cushioning/.

(Continued)

*Primary Examiner* — Praachi M Pathak
(74) *Attorney, Agent, or Firm* — Venable LLP

(57) ABSTRACT

A packing material including a strip of corrugated cellulosic material and a method of packing an object in a shipping box using the packing material. The strip of corrugated cellulosic material includes a plurality of macro flutes and is moveable between an expanded state and a compressed state. The strip of corrugated cellulosic material is in the compressed state when a compression force is applied to the strip of corrugated cellulosic material in the longitudinal direction and in the expanded state when the compression force is removed. The length of the strip of corrugated cellulosic material is longer in the expanded state than the compressed state.

20 Claims, 27 Drawing Sheets

Related U.S. Application Data on May 20, 2021, provisional application No. 63/229,617, filed on Aug. 5, 2021, provisional application No. 63/321,555, filed on Mar. 18, 2022.

(51) Int. Cl.

| | |
|---|---|
| ***B65D 65/38*** | (2006.01) |
| ***B65D 65/40*** | (2006.01) |
| ***B65D 81/05*** | (2006.01) |
| ***B65D 81/127*** | (2006.01) |
| ***B65D 81/107*** | (2006.01) |

(56) References Cited

U.S. PATENT DOCUMENTS 2,924,154 A 2/1960 Russell et al.
2,978,006 A 4/1961 Clemens
3,074,543 A 1/1963 Stanley
3,131,240 A 4/1964 Kirkpatrick
3,509,797 A 5/1970 Johnson
3,530,020 A 9/1970 Liebermann
3,546,055 A 12/1970 Spertus
3,613,985 A 10/1971 Goodsite
3,650,877 A 3/1972 Johnson
3,655,500 A 4/1972 Johnson
3,780,929 A 12/1973 Terrasi
3,812,618 A 5/1974 Wood et al.
3,900,156 A 8/1975 Clark, Jr.
4,212,394 A 7/1980 Alley
4,384,442 A 5/1983 Pendelton
4,640,080 A * 2/1987 Wright ..... B65D 81/09 53/472
4,644,733 A 2/1987 Dolinar
4,680,918 A 7/1987 Lovell
4,806,410 A 2/1989 Armington et al.
4,828,913 A 5/1989 Kiss
4,865,201 A 9/1989 Liebel
4,880,119 A 11/1989 Simon
4,937,131 A 6/1990 Baldacci et al.
4,997,091 A 3/1991 McCrea
5,205,473 A 4/1993 Coffin, Sr.
5,230,943 A 7/1993 Pregont
5,251,414 A 10/1993 Duke
5,312,665 A 5/1994 Pratt et al.
5,330,165 A 7/1994 van Goubergen
5,340,638 A 8/1994 Sperner
5,431,985 A 7/1995 Schilling
5,439,542 A 8/1995 Liebel
5,468,556 A 11/1995 Fuss et al.
5,515,975 A * 5/1996 Jarvis ..... B65D 81/052 206/524.8
5,545,297 A 8/1996 Andersen et al.
5,568,867 A 10/1996 Lencoski
5,569,519 A 10/1996 Ervay et al.
5,595,811 A 1/1997 Stout, Jr.
5,623,815 A 4/1997 Hornstein et al.
5,636,744 A 6/1997 Hirose
5,639,543 A 6/1997 Isoda et al.
5,658,624 A 8/1997 Anderson et al.
5,674,344 A 10/1997 Thompson et al.
5,683,772 A 11/1997 Andersen et al.
5,688,578 A 11/1997 Goodrich
5,702,560 A 12/1997 Skinner
5,756,127 A 5/1998 Grisoni et al.
5,826,404 A 10/1998 Fuss et al.
5,871,857 A 2/1999 Alhamad
5,900,119 A 5/1999 Goers et al.
5,910,079 A 6/1999 Watanabe
5,910,089 A 6/1999 Weder
5,944,192 A 8/1999 Weder
5,992,637 A 11/1999 Weder
6,067,779 A 5/2000 Weder
6,128,889 A * 10/2000 Fuss ..... B65B 67/06 53/472
6,153,037 A * 11/2000 Kim ..... B31F 1/28 156/472
6,199,700 B1 3/2001 Yamamoto et al.
6,254,945 B1 7/2001 Simmons
6,257,412 B1 7/2001 Yamamoto et al.
6,298,637 B1 10/2001 Weder
6,385,949 B2 5/2002 Weder
6,532,721 B1 3/2003 Weder
6,546,701 B2 4/2003 Weder et al.
6,632,165 B1 10/2003 Letourneau et al.
6,752,910 B2 6/2004 Sato et al.
6,871,480 B1 3/2005 Goodrich
6,969,548 B1 11/2005 Goldfine
7,074,290 B2 7/2006 Miyazaki et al.
7,204,070 B2 4/2007 Mertz, II et al.
7,651,455 B2 1/2010 Yampolsky et al.
7,803,100 B2 9/2010 Lu et al.
3,052,037 A1 11/2011 Bussey, III et al.
8,146,748 B2 4/2012 Vulpitta
8,201,671 B2 6/2012 Cho
8,360,949 B2 1/2013 Wetsch et al.
8,763,667 B2 7/2014 De Luca
8,900,111 B2 12/2014 Wetsch et al.
8,999,490 B2 4/2015 Kung et al.
9,205,621 B2 12/2015 Cheich
9,315,312 B2 4/2016 De Luca et al.
9,427,928 B2 8/2016 Arora et al.
9,457,982 B2 10/2016 Wetsch et al.
9,688,044 B2 6/2017 Deis et al.
10,099,836 B2 10/2018 Cheich
10,357,936 B1 7/2019 Vincent et al.
10,392,177 B2 8/2019 Lantz
10,766,220 B2 9/2020 Deis et al.
10,766,221 B2 9/2020 Deis et al.
10,792,882 B2 10/2020 Wetsch et al.
10,828,859 B2 11/2020 Ciasullo, Jr. et al.
11,104,501 B1 8/2021 Voorhees
11,123,943 B2 9/2021 Cheich et al.
11,161,668 B1 * 11/2021 Hermanson ..... B29C 43/36
2002/0040859 A1 4/2002 Weder
2003/0051819 A1 3/2003 Moustier
2004/0050743 A1 3/2004 Slovencik et al.
2004/0052988 A1 3/2004 Slovencik et al.
2004/0108243 A1 6/2004 Jeannin
2005/0230864 A1 10/2005 Ozasa et al.
2006/0281621 A1 12/2006 Weder
2007/0082181 A1 4/2007 Jung
2008/0086982 A1 * 4/2008 Parenteau ..... E04C 2/365 52/794.1
2008/0153685 A1 6/2008 Cheich et al.
2009/0082187 A1 3/2009 Cheich et al.
2010/0323153 A1 12/2010 Huskey
2011/0053743 A1 3/2011 Wetsch et al.
2011/0061986 A1 3/2011 Orsini et al.
2012/0097067 A1 4/2012 Fascio
2012/0165172 A1 6/2012 Wetsch et al.
2013/0313277 A1 11/2013 Stewartson et al.
2014/0127475 A1 5/2014 Bonebrake
2014/0155241 A1 6/2014 Cheich et al.
2016/0060014 A1 3/2016 Timmers et al.
2016/0221233 A1 8/2016 Kiiskinen et al.
2018/0029764 A1 2/2018 Chung et al.
2018/0030659 A1 2/2018 Chung et al.
2018/0126686 A1 5/2018 Nelson et al.
2018/0264768 A1 9/2018 Haug
2018/0319116 A1 11/2018 Haug
2018/0370702 A1 12/2018 Goodrich
2020/0061951 A1 2/2020 Slovencik
2020/0063361 A1 2/2020 Everett et al.
2020/0115087 A1 4/2020 Hagestedt et al.
2020/0139661 A1 5/2020 Greenwell
2021/0179333 A1 6/2021 Wetsch

FOREIGN PATENT DOCUMENTS

EP 0 631 949 A2 7/1994
EP 0 666 170 A1 11/1994
EP 2 476 551 A1 1/2012
JP H06-247471 A 9/1994

(56) References Cited

FOREIGN PATENT DOCUMENTS

| | | | |
|---|---|---|---|
| JP | H08-244853 | A | 9/1996 |
| JP | 2002-225946 | A | 4/2002 |
| WO | 92/04253 | A1 | 3/1992 |
| WO | 91/18807 | A1 | 12/1992 |
| WO | 94/12576 | | 6/1994 |
| WO | 97/09248 | | 3/1997 |
| WO | 00/05150 | A1 | 2/2000 |
| WO | 2011/059347 | A1 | 5/2011 |
| WO | 2020/120575 | A2 | 6/2020 |

OTHER PUBLICATIONS

ExpandOS, https://expandos.com, visited Oct. 29, 2020.
"Paper Packaging Applications", Paper Packaging Systems, https://www.paperpackagingsystems.com/paper-packaging-applications-paper, visited Oct. 29, 2020.
"Crinkle Cut Fill", Bags and Bows Online, https://www.bagsandbowsonline.com/retail-packaging/search?Ntt=crinkle cutfill, visited Oct. 29, 2020.
"Honeycomb & Corrugate Dunnage", The Wayback Machine, https://web.archive.org/web/20141126093116/http://completepackaging.com:80/honeycomb-corrugate-dunnage/.
"100% Recycled Corrugated Bubble", EcoEnclose, ecoencose.com, https://web.archive.org/web/20211008220758/https://www.ecoenclose.com/shop/void-fill-accessories/100-recycled-corrugated-bubble/.
"HSM ProfiPack 425 Cardboard Converter", HSM, hsm-shredder.com, https://web.archive.org/web/20210120103545/https://www.hsm-shredder.com/hsm-profipack-p425-cardboard-converter.html.
"Crinkle Paper", ULINE, www.uline.com/BL_1908/Crinkle-Paper.
Foam Alternative: Corrispring Cardboard Cushioning Inserts; GWP Packaging; https://www.gwp.co.uk/packaging/inserts/foam-alternative/#details (retrieved May 1, 2023).

* cited by examiner

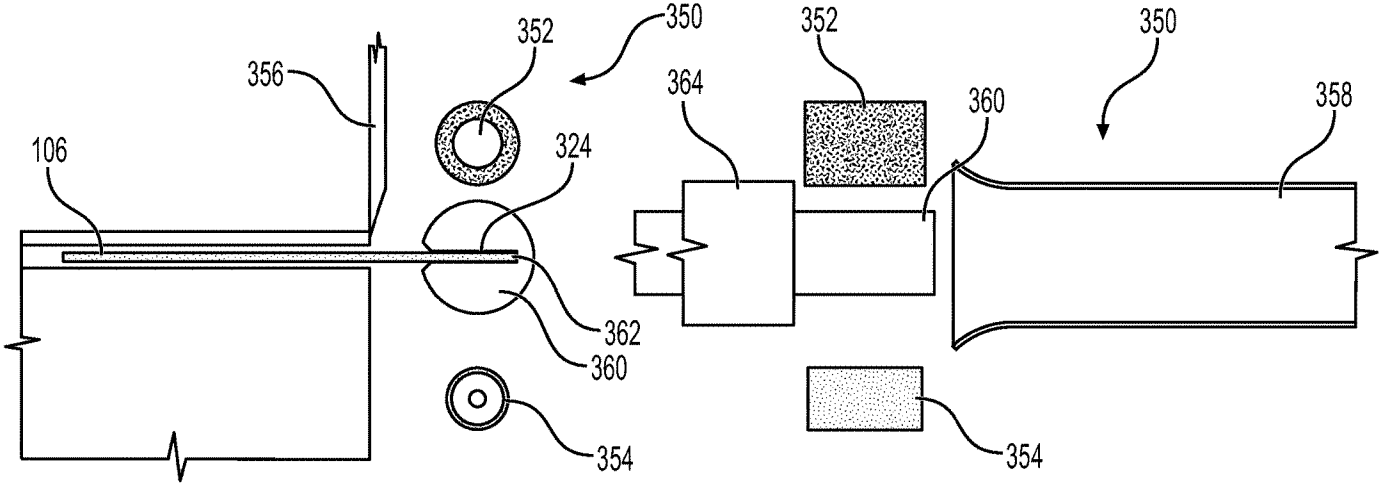
FIG. 17A
FIG. 17B
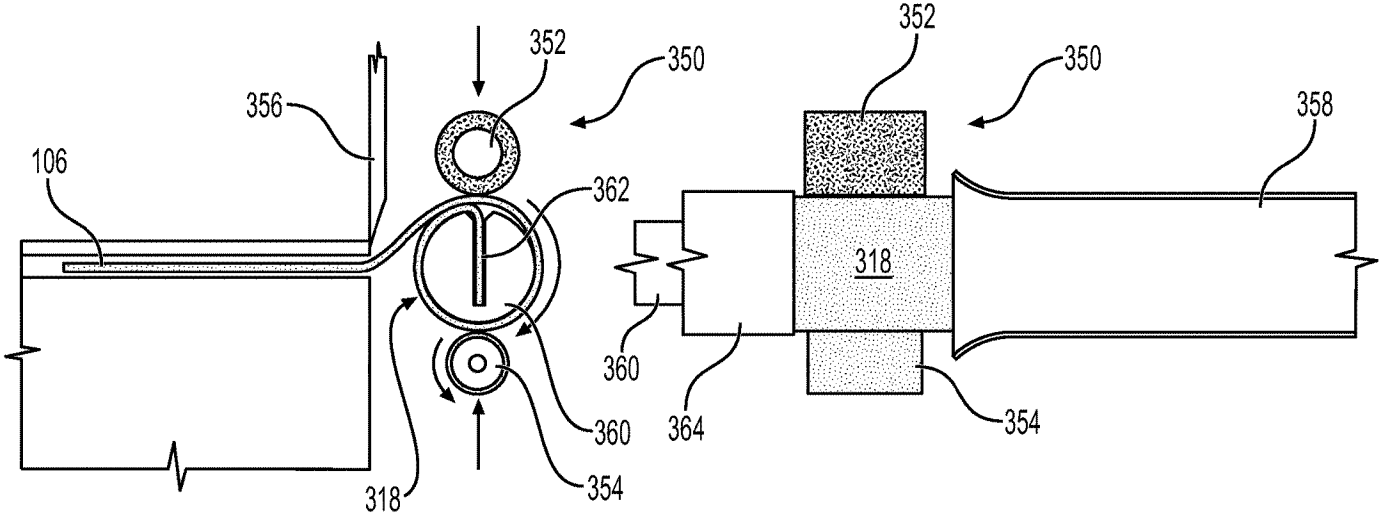
FIG. 18A
FIG. 18B

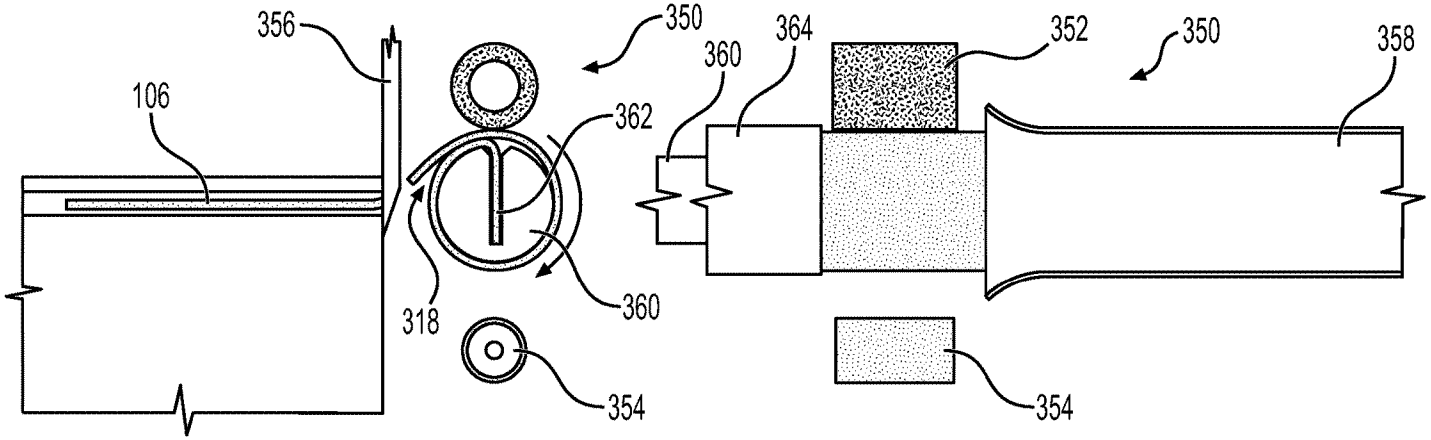
FIG. 19B
FIG. 19A
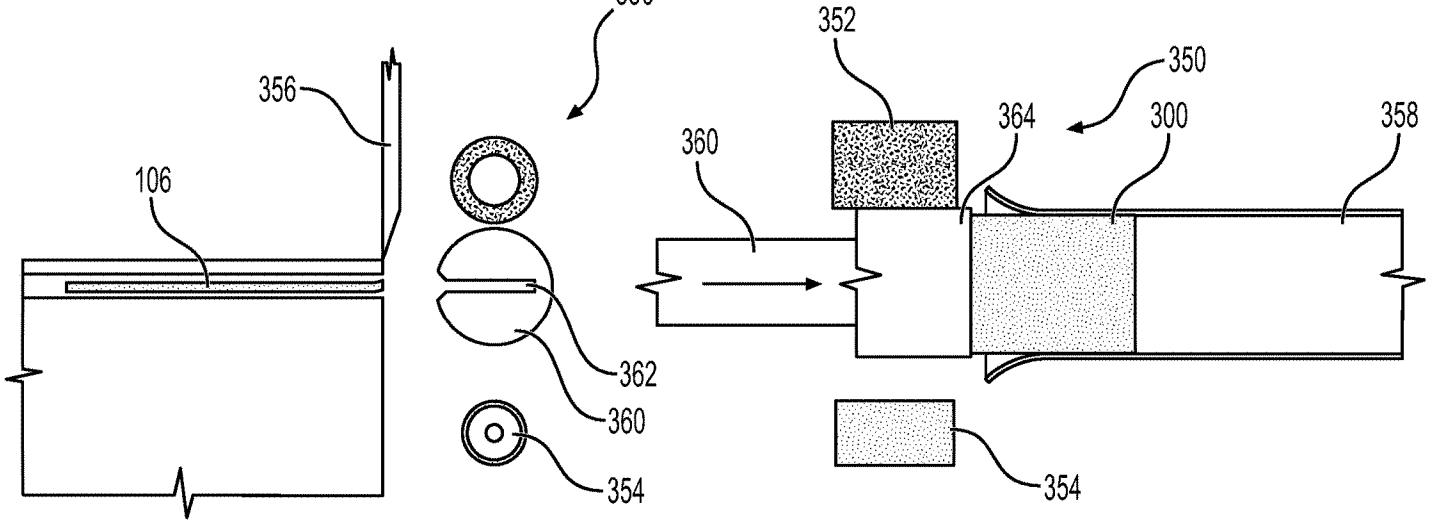
FIG. 20B
FIG. 20A

METHOD OF PACKING AN OBJECT IN A SHIPPING BOX

CROSS-REFERENCE TO RELATED APPLICATIONS

This application claims the benefit under 35 U.S.C. § 119(e) of the following U.S. provisional patent applications: U.S. Provisional Patent Application No. 63/185,124, filed May 6, 2021, and titled "PACKING MATERIAL AND METHOD OF MANUFACTURING THE PACKING MATERIAL;" U.S. Provisional Patent Application No. 63/191,088, filed May 20, 2021, and titled "PACKING MATERIAL AND METHOD OF MANUFACTURING THE PACKING MATERIAL;" U.S. Provisional Patent Application No. 63/229,617, filed Aug. 5, 2021, and titled "PACKING MATERIAL AND METHOD OF MANUFACTURING THE PACKING MATERIAL;" and U.S. Provisional Patent Application No. 63/321,555, filed Mar. 18, 2022, and titled "PACKING MATERIAL AND METHOD OF MANUFACTURING THE PACKING MATERIAL." The forgoing applications are incorporated herein by reference in their entirety.

FIELD OF THE INVENTION

The invention relates to packing material and methods of manufacturing the same.

BACKGROUND OF THE INVENTION

Various packing materials are used to secure items in shipping containers, including cardboard boxes, to thereby prevent damage to these items if they move within the shipping container during shipment or other impacts during shipping, such as being dropped or hit. Such packing materials include bubble wrap, expanded polystyrene (polystyrene foam) and other plastic foam packing, which may be molded into blocks or into other shapes, peanuts, and inflated plastic bags (also known as air pillows). These plastic products may be discarded as waste after they have been used during shipping. Plastic waste takes a long time to decompose and produces carbon dioxide in the decomposition process. In addition, polystyrene foam does not readily biodegrade and may take many, many years to break down. With an increased awareness of the negative effects of plastics and polystyrene foam on the environment, however, consumers are increasingly seeking to use environmentally-friendly, recyclable, and biodegradable products as a packing material. There are desired environmentally-friendly, recyclable, and biodegradable products that provide sufficient cushioning effects at an affordable cost.

SUMMARY OF THE INVENTION

In one aspect, the invention relates to a packing material including a strip of corrugated cellulosic material. The strip of corrugated cellulosic material has a longitudinal direction, a transverse direction, a first end in the longitudinal direction, and a second end in the longitudinal direction. The corrugated cellulosic material includes at least one corrugated cellulosic sheet with a plurality of interior flutes. The strip of corrugated cellulosic material also includes a plurality of macro flutes. Each macro flute is oriented in the transverse direction. The strip of corrugated cellulosic material is moveable between an expanded state and a compressed state. The strip of corrugated cellulosic material is in the compressed state when a compression force is applied to the strip of corrugated cellulosic material in the longitudinal direction and in the expanded state when the compression force is removed. The length of the strip of corrugated cellulosic material is longer in the expanded state than the compressed state.

In another aspect, the invention relates to a packing material including a strip of corrugated cellulosic material. The strip of corrugated cellulosic material has a longitudinal direction, a transverse direction, a first end in the longitudinal direction, and a second end in the longitudinal direction. The corrugated cellulosic material includes at least one corrugated cellulosic sheet with a plurality of interior flutes. The strip of corrugated cellulosic material is formed into a plurality of alternating ridges and grooves that are aligned in the transverse direction. The strip of corrugated cellulosic material is moveable between an expanded state and a compressed state. The strip of corrugated cellulosic material is in the compressed state when a compression force is applied to the strip of corrugated cellulosic material in the longitudinal direction and in the expanded state when the compression force is removed. The length of the strip of corrugated cellulosic material is longer in the expanded state than the compressed state.

In a further aspect, the invention relates to a method of packing an object in a shipping box. The method includes providing a shipping box including an interior with an object placed in the interior of the shipping box and maintaining a packing material in a compressed state by applying a compression force in a longitudinal direction of the packing material. The packing material is a strip of corrugated cellulosic material that includes a plurality of macro flutes. Each macro flute is oriented in a transverse direction that is transverse to the longitudinal direction of the packing material. The corrugated cellulosic material includes at least one corrugated cellulosic sheet with a plurality of interior flutes. The method also includes placing the packing material in the compressed state into a space formed between the object and the shipping box and releasing the compression force and allowing the packing material to expand to an expanded state. The length of the strip of corrugated cellulosic material is longer in the expanded state than the compressed state.

These and other aspects of the invention will become apparent from the following disclosure.

BRIEF DESCRIPTION OF THE DRAWINGS

FIG. 1A shows a single-walled corrugated fiberboard, and FIG. 1B shows a double-walled corrugated fiberboard.

FIG. 4A is a side view of the conveyor system, and FIG. 4B is a top view of the conveyor system.

FIG. 5A shows the expandable fluted corrugated strip in a compressed state (collapsed state), and FIG. 5B shows the expandable fluted corrugated strip in the expanded state.

FIG. 6A shows a first step and a machine used to form the expandable fluted corrugated strip. FIG. 6B shows a second step of forming the expandable fluted corrugated strip. FIG. 6C shows the expandable fluted corrugated strip in a holder.

FIG. 7A shows a holder filled with the expandable fluted corrugated strip stored in the compressed state. FIG. 7B shows the expandable fluted corrugated strip being removed from the holder. FIG. 7C shows a shipping box with an object-to-be-shipped placed therein and the expandable fluted corrugated strip being placed therein. FIG. 7D shows the expandable fluted corrugated strip expanding from the compressed state to the expanded state in the interior of the shipping box. FIG. 7E shows the object-to-be-shipped packed in the shipping box with the expandable fluted corrugated strip filling extra space within the interior of the shipping box.

FIG. 11A shows the finned corrugated strip.

FIG. 11B is a detail view of the finned corrugated strip, showing detail 11B in FIG. 11A.

FIG. 11C shows another arrangement of the finned corrugated strip.

FIG. 12A shows a first step. FIG. 12B shows a second step. FIG. 12C shows a third step. FIG. 12D shows a fourth step.

FIG. 15A shows the mass compressing the coiled corrugated cellulosic cushioning element, and FIG. 15B shows the mass lifted from the coiled corrugated cellulosic cushioning element.

FIGS. 17A and 17B illustrate a machine used to form the packing material shown in FIGS. 14A and 14B. FIG. 17A shows one side view of the machine, and FIG. 17B shows another side view of the machine. FIGS. 17A and 17B show a first step.

FIGS. 18A and 18B show a second step using the machine shown in FIGS. 17A and 17B, respectively. FIG. 18A shows one side view of the machine, and FIG. 18B shows another side view of the machine.

FIGS. 19A and 19B show a third step using the machine shown in FIGS. 17A and 17B, respectively. FIG. 19A shows one side view of the machine, and FIG. 19B shows another side view of the machine.

FIGS. 20A and 20B show a fourth step using the machine shown in FIGS. 17A and 17B, respectively. FIG. 20A shows one side view of the machine, and FIG. 20B shows another side view of the machine.

FIG. 24A is a side view of the conveyor system and assembly, and FIG. 24B is a top view of the conveyor system and assembly.

FIG. 26A shows a first step. FIG. 26B shows a second step. FIG. 26C shows a third step.

FIG. 27A shows a first step. FIG. 27B shows a second step. FIG. 27C shows a third step. FIG. 27D shows a fourth step. FIG. 27E shows a fifth step. FIG. 27E shows a sixth step.

FIG. 28A is a side view taken along line 28A-28A in FIG. 28B.

DETAILED DESCRIPTION OF THE PREFERRED EMBODIMENTS

With the rise in online shopping and home delivery, more and more packages are being delivered, giving rise to an increased need for environmentally-friendly, recyclable, and biodegradable packing material, as noted above. Such needs are particularly prevalent at so-called fulfillment centers where products are delivered to a warehouse facility and then subsequently packaged for delivery to a consumer. Such facilities also have a significant amount of waste material from corrugated boxes and in some cases the fulfillment center pays to recycle this corrugated waste material. The methods discussed herein transform this corrugated waste material into various packing material that can be used to cushion a product and/or to provide dunnage for a product within a shipping box.

The packing materials discussed herein are preferably formed from cellulosic material such as paper, paperboard, and/or corrugated cardboard (corrugated cellulosic material), as such materials are biodegradable. Preferably, such materials are recycled (e.g., previously-used). Recycled corrugated cellulosic material may include, for example, corrugated carboard shipping boxes. Previously used corrugated cardboard shipping boxes (scrap shipping box) may be used as the base material for the packing materials discussed herein.

Figure 1A:
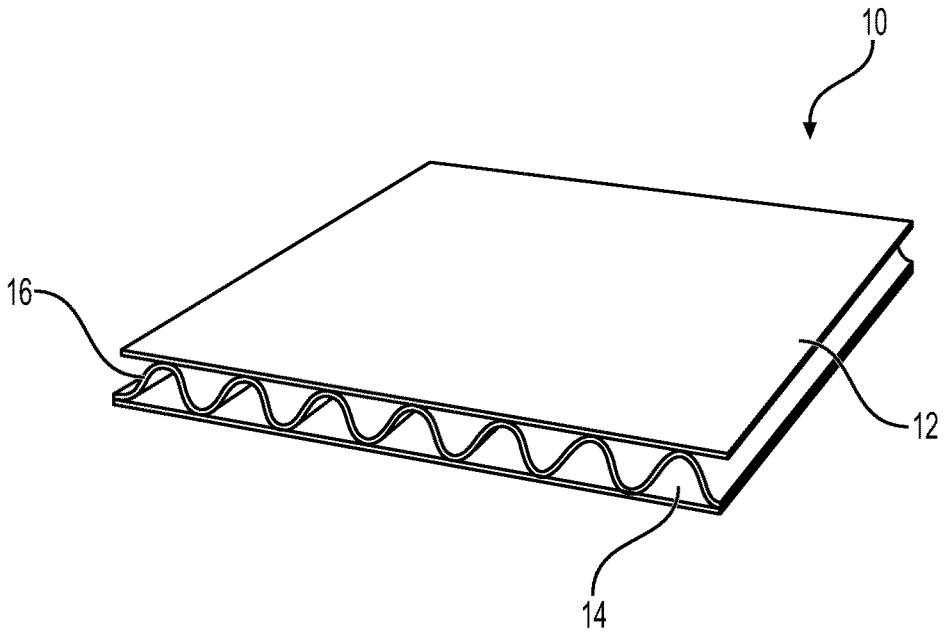
FIGS. 1A and 1B show corrugated cellulosic materials that may be used to form packing materials.
Figure 1B:
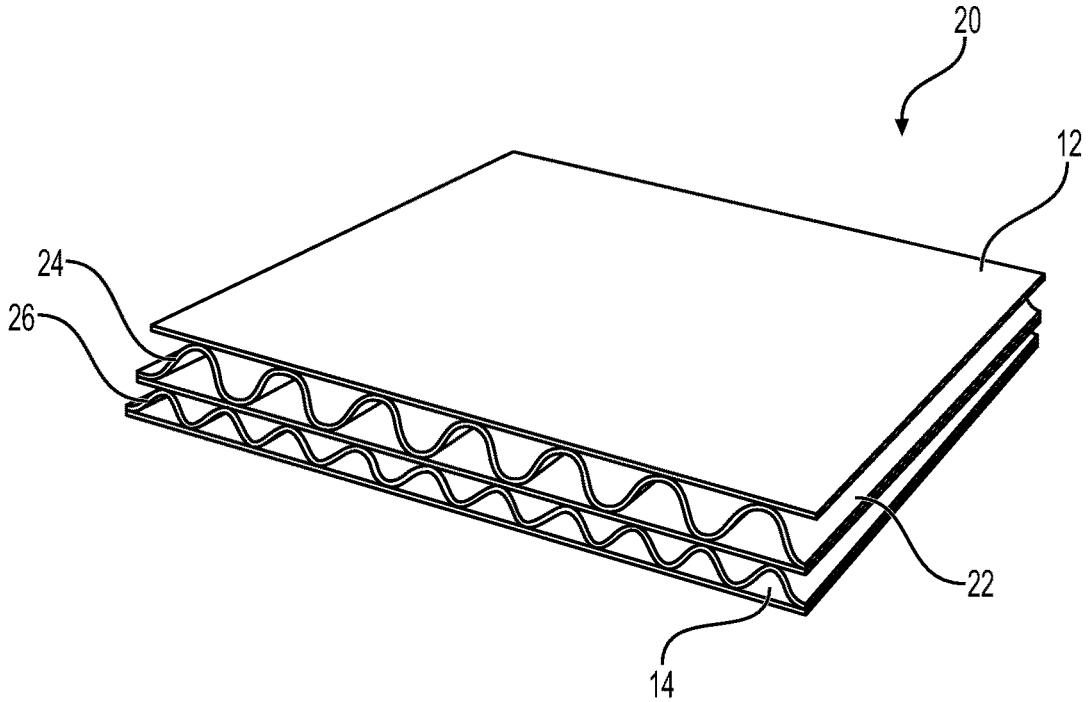

FIGS. 1A and 1B show corrugated cellulosic materials that may be used in the packing materials discussed herein. FIG. 1A shows a single-walled corrugated fiberboard 10. The single-walled corrugated fiberboard 10 includes atop sheet 12, a bottom sheet 14, and one corrugated sheet 16 sandwiched between the top sheet 12 and the bottom sheet 14. FIG. 1B shows a double-walled corrugated fiberboard 20. In addition to the top sheet 12 and the bottom sheet 14, the double-walled corrugated fiberboard 20 includes an intermediate or middle sheet 22. The double-walled corrugated fiberboard 20 includes a first corrugated cellulosic sheet 24 sandwiched between the top sheet 12 and the middle sheet 22, and a second corrugated cellulosic sheet 26 sandwiched between the middle sheet 22 and the bottom sheet 14. Each of the liners (top sheet 12, the bottom sheet 14, and the middle sheet 22) and the corrugated sheets (corrugated sheet 16, first corrugated cellulosic sheet 24, and first corrugated cellulosic sheet 24) may be suitable sheets made from cellulosic fibers that are typically used in the construction of cardboard shipping boxes. The corrugated sheets (corrugated sheet 16, first corrugated cellulosic sheet 24, and first corrugated cellulosic sheet 24) each include a plurality of flutes. Any suitable standard flute shape typically used in the construction of cardboard shipping boxes may be used. These flutes are referred to herein as interior flutes to distinguish them from other flutes formed in the packing materials discussed below. The corrugated cellulosic materials used in the packing materials discussed herein are not limited to the single-walled corrugated fiberboard 10 and the double-walled corrugated fiberboard 20, and other suitable corrugated fiberboard may be used including single-face fiberboard or triple-walled fiberboard.

Figure 2A:
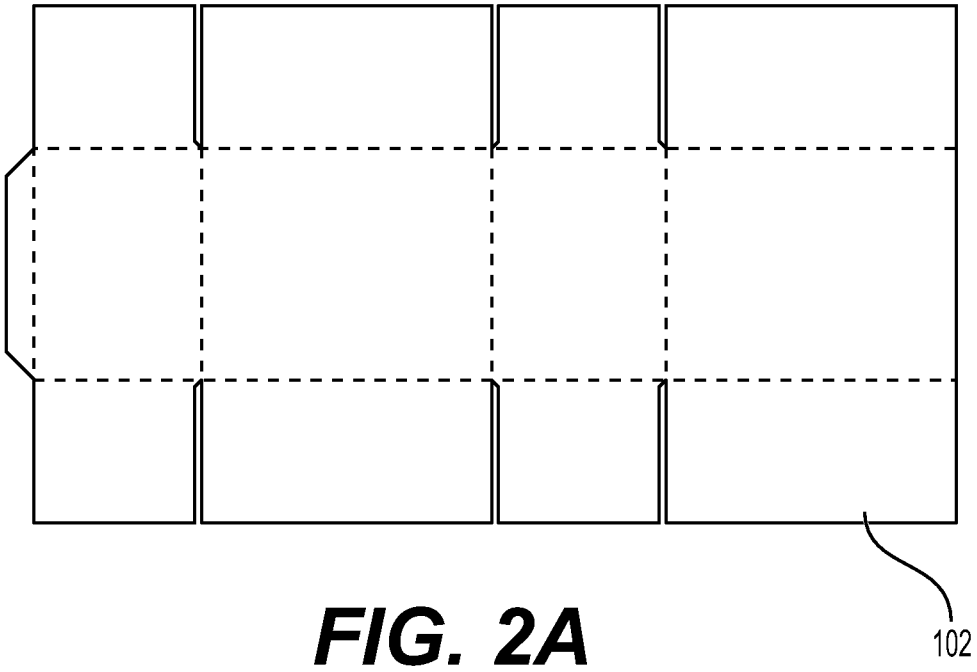
FIG. 2A shows an unfolded scrap shipping box.
Figure 2B:
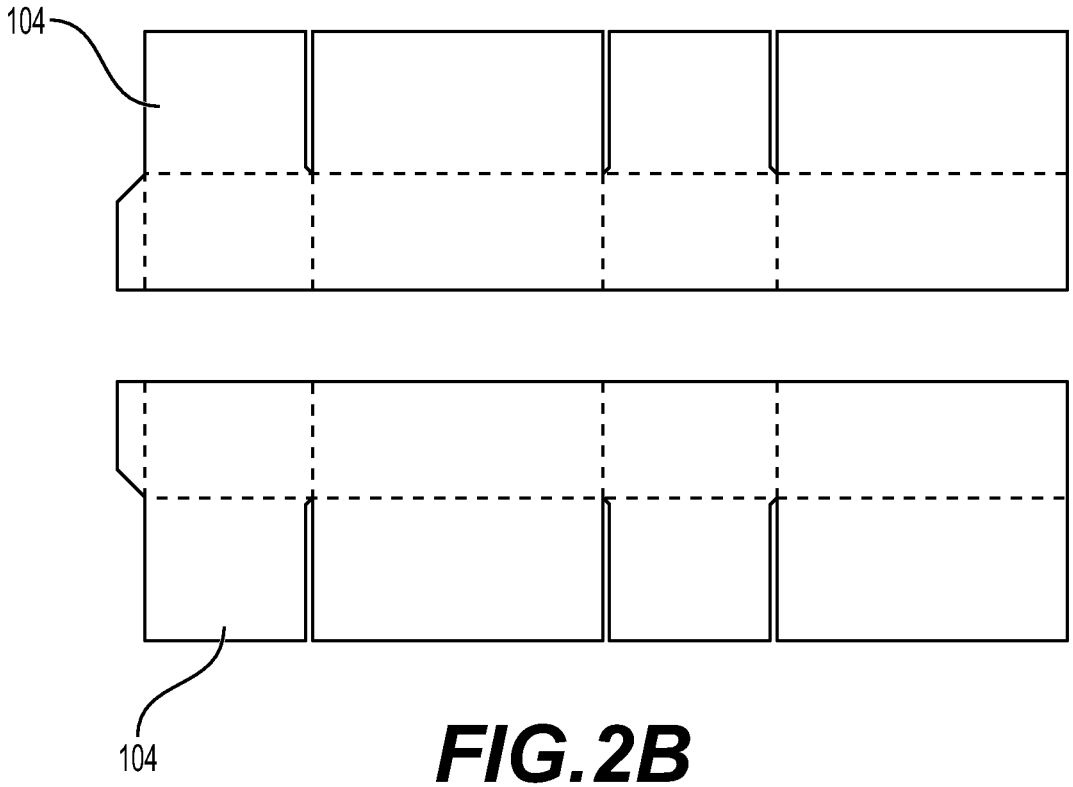
FIG. 2B shows the unfolded scrap shipping box sized to form sized corrugated stock material.

FIGS. 2A-4B show how a scrap shipping box may be used to form strips of corrugated stock material that will be used to form the packing materials discussed herein. A scrap shipping box may be unfolded, as shown in FIG. 2A, to form an unfolded scrap shipping box 102. Shipping boxes and thus the unfolded scrap shipping box 102 may have various sizes. The unfolded scrap shipping box 102 may be sized to a standard size for use in subsequent processing. For example, the unfolded scrap shipping box 102 may be sliced in a longitudinal direction, as shown in FIG. 2B, to have a width that can be processed by a machine to create strips of corrugated stock material. Although in this example, the unfolded scrap shipping box 102 is sliced longitudinally to create sized corrugated stock material 104, any suitable method may be used to size the unfolded scrap shipping box 102 for subsequent processing.

Figure 3:
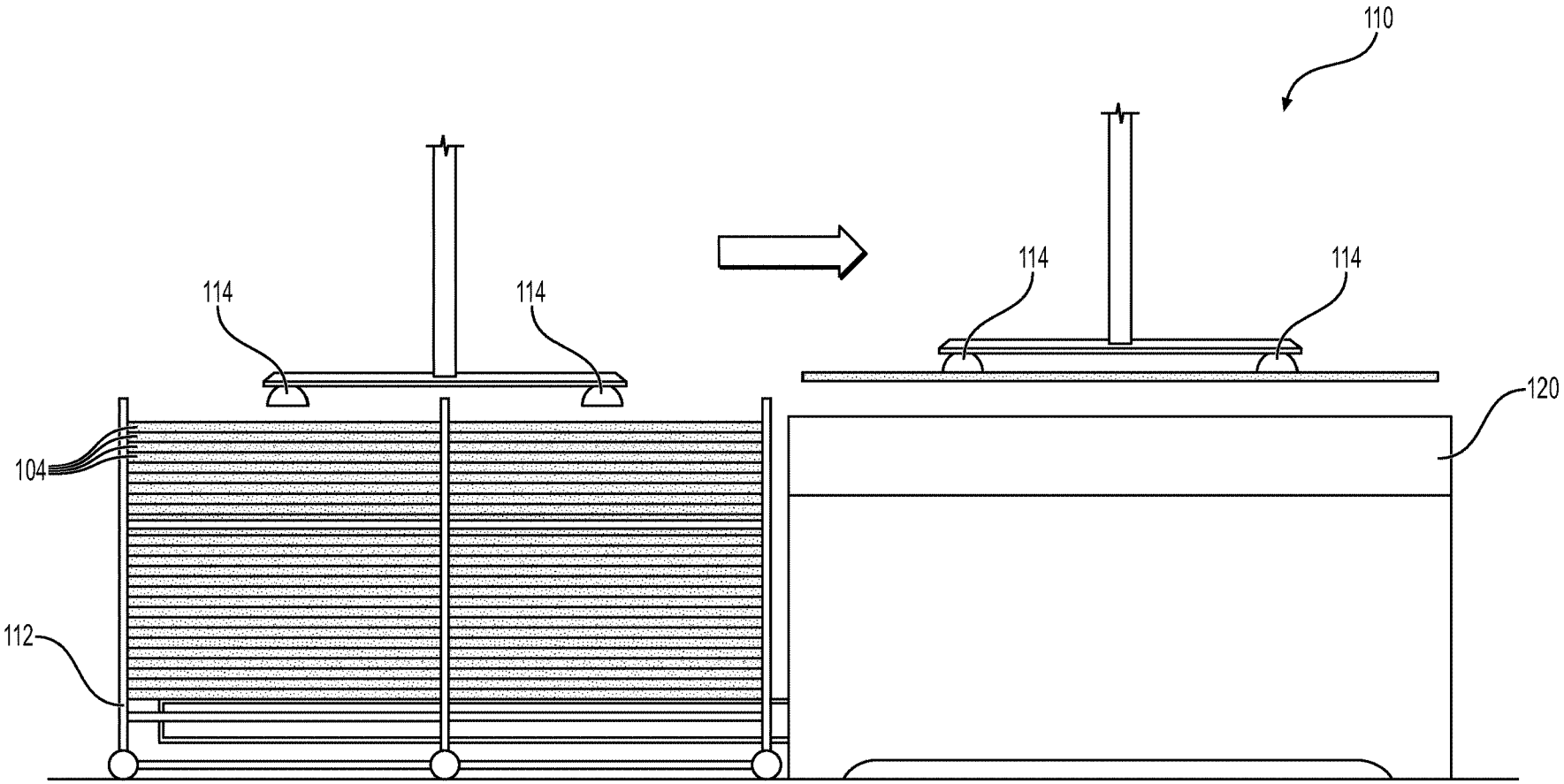
FIG. 3 shows a machine that may be used to form corrugated stock material strips.

FIG. 3 shows a machine 110 and process that may be used to form strips of corrugated stock material (referred to herein as corrugated stock material strips 106). The sized corrugated stock material 104 may be stacked in a magazine 112. The magazine 112 stores the corrugated stock material 104 that is used to feed the machine 110. In this embodiment, a vacuum pick-up 114 is used to individually pick up the sized corrugated stock material 104 and place it on a conveyor system 120. Any suitable method, however, may be used to feed the sized corrugated stock material 104 in the conveyor system 120 to form the corrugated stock material strips 106.

Figure 4A:
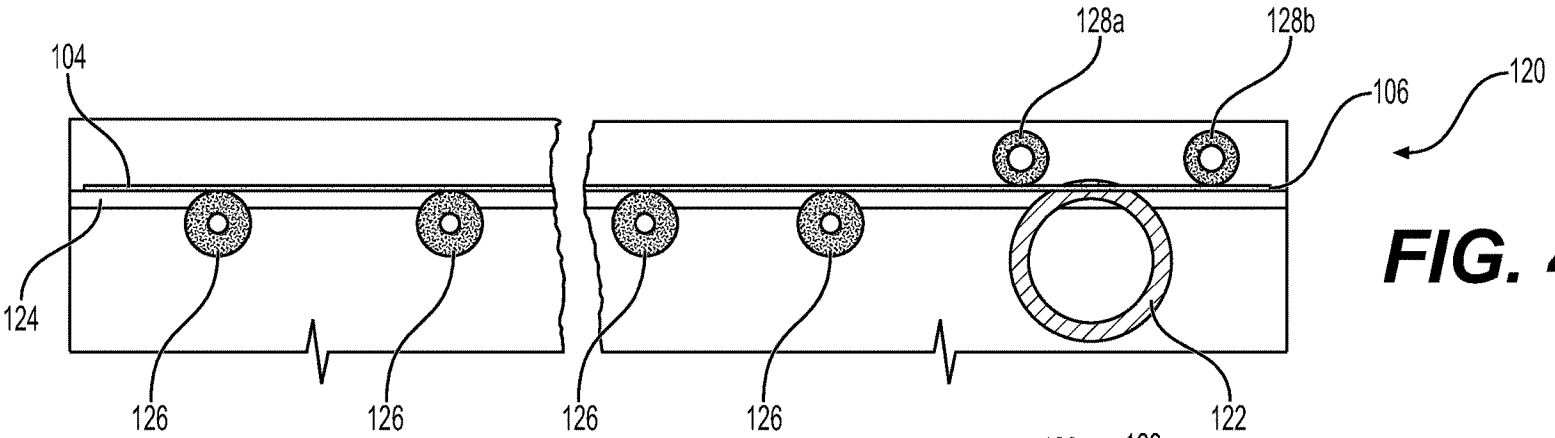
FIGS. 4A and 4B show a conveyor system of the machine shown in FIG. 3.
Figure 4B:
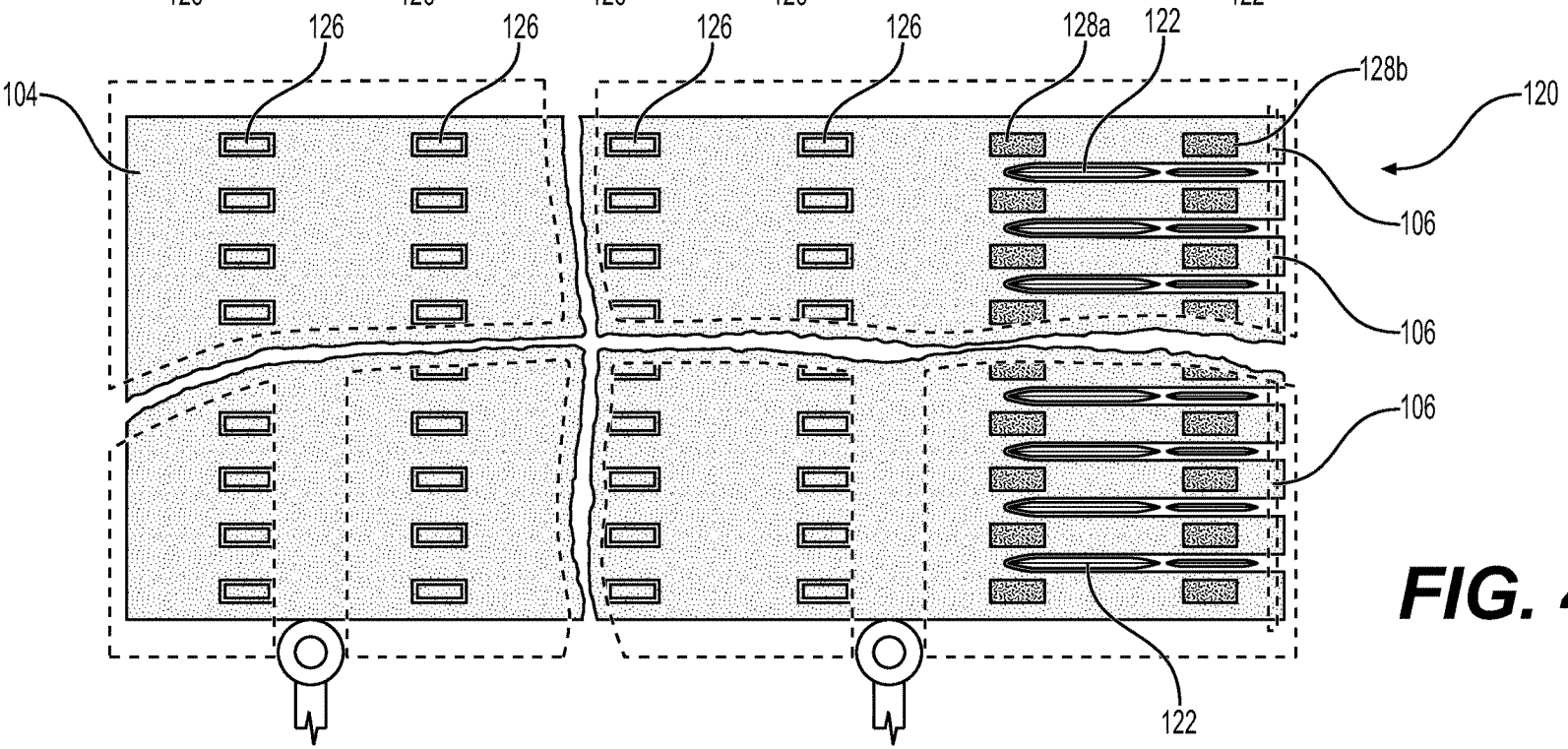

The conveyor system 120 is shown in FIGS. 4A and 4B. FIG. 4A is a side view of the conveyor system 120, and FIG. 4B is a top view of the conveyor system 120. The corrugated stock material 104 is shown with translucent stippling in FIG. 4B to illustrate the features of the conveyor system 120. The sized corrugated stock material 104 is further cut on the conveyor system 120 using, for example, a plurality of disk cutters 122 to form the corrugated stock material strips 106. Each of the disk cutters 122 is arranged parallel to each other and protrude upward through slots formed in a support surface 124. The sized corrugated stock material 104 is placed on the support surface 124 by the vacuum pick-up 114 (see FIG. 3) and moved toward the disk cutters 122 by a plurality of conveyor rollers 126. At least one feed roller is used to feed the sized corrugated stock material 104 into the disk cutters 122. In this embodiment, a plurality of upstream feed rollers 128*a*, nips the sized corrugated stock material 104 between each of the upstream feed roller 128*a* and the support surface 124, and the upstream feed rollers 128*a* feed the sized corrugated stock material 104 into the disk cutters 122 where it is cut in a longitudinal direction of the sized corrugated stock material 104 to from corrugated stock material strips 106. This embodiment also includes a plurality of downstream feed rollers 128*b* that nip each corrugated stock material strips 106 between a corresponding downstream feed roller 128*b* and the support surface 124, and the downstream feed rollers 128*b* conveys (feeds) the corrugated stock material strips 106 for subsequent processing.

Figure 5A:
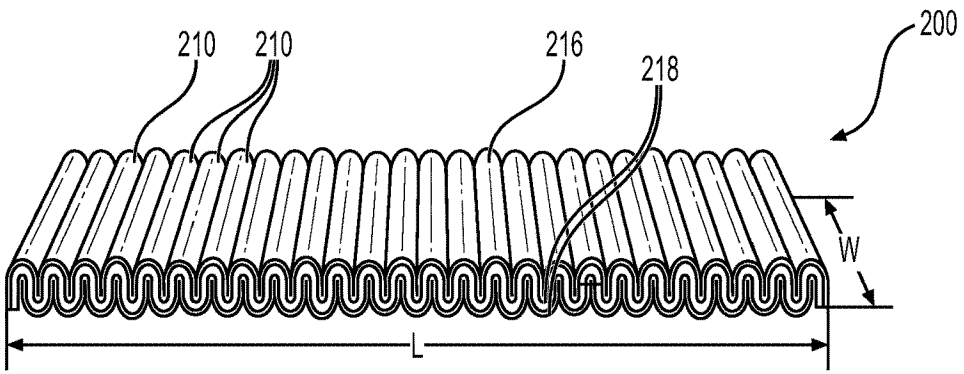
FIGS. 5A and 5B show a packing material (expandable fluted corrugated strip) according to a preferred embodiment the invention.
Figure 5B:
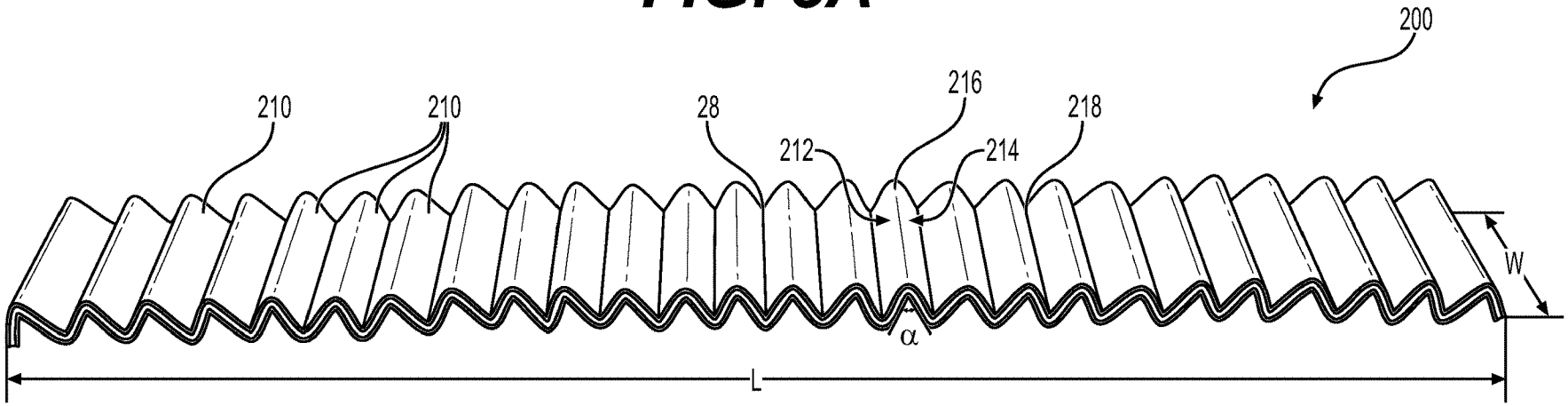

FIGS. 5A and 5B show a packing material according to a preferred embodiment of the invention. For clarity with the other packing materials discussed herein, the packing material of this embodiment is referred to as an expandable fluted corrugated strip 200. The expandable fluted corrugated strip 200 of this embodiment expands from a compressed state (collapsed state), as shown in FIG. 5A, to an expanded state shown in FIG. 5B. The expandable fluted corrugated strip 200 includes a plurality of macro flutes 210 that are arranged parallel to each other. These macro flutes 210 will be referred to as macro flutes 210 to distinguish these flutes from the interior flutes discussed above. In this embodiment, the macro flutes 210 of the expandable fluted corrugated strip 200 are parallel to the interior flutes of the corrugated material (e.g., the interior flutes of corrugated sheet 16 in FIG. 1A) used to form the fluted corrugated strip. The expandable fluted corrugated strip 200 includes a length L and a width W. In the expanded state, the length L of the expandable fluted corrugated strip 200 is greater than the width W. The expandable fluted corrugated strip 200 includes a longitudinal direction that is in the length direction of the expandable fluted corrugated strip 200. Each flute 210 of this embodiment is oriented transverse to the longitudinal direction and, more specifically, perpendicular to the longitudinal direction such that the macro flutes 210 are oriented in the width direction W of the expandable fluted corrugated strip 200.

In this embodiment, the macro flutes 210 have a generally triangular shape (or V-shape) with a first planar surface 212 connected to a second planar surface 214 at a peak 216. Adjacent macro flutes 210 are connected to each other at a valley 218, providing a structure of a plurality of alternating ridges (peaks 216) and grooves (valleys 218). In other embodiments, adjacent macro flutes 210 may be separated from each other with a connecting portion (similar to the base section 240 discussed below) therebetween. The first planar surface 212 and the second planar surface 214 form an included angle $\alpha$ therebetween. The macro flutes 210 in this embodiment have the same height and spacing, but they are not so limited and may have different heights and spacings.

In the compressed state, the first planar surface 212 and the second planar surface 214 are positioned closer to each other than they are in the expanded state. In the compressed state, the first planar surface 212 and the second planar surface 214 are arranged such that they are close to parallel to each other, minimizing the length L of the expandable fluted corrugated strip 200. In the compressed state, the included angle $\alpha$ is less than it is in the expanded state, and the included angle $\alpha$ may approach zero with each peak 216 and valley 218 contacting an adjacent peak 216 or valley 218, respectively. Likewise, the first planar surface 212 of one flute 210 may abut the second planar surface 214 of an adjacent flute 210 when the expandable fluted corrugated strip 200 is in the compressed state. As noted above, the expandable fluted corrugated strip 200 of this embodiment is formed from corrugated cellulosic material (e.g., the single-walled corrugated fiberboard 10 shown in FIG. 1A or the double-walled corrugated fiberboard 20 shown in FIG. 1B). The corrugated cellulosic material provides the expandable fluted corrugated strip 200 with elasticity. A compressive force may be applied against the elasticity of the expandable fluted corrugated strip 200, and the expandable fluted corrugated strip 200 is maintained in the compressed state (a deformed state) by a compressive force applied in a direction parallel to the longitudinal axis of the expandable fluted corrugated strip 200. When the compressive force is released, the elasticity of the corrugated cardboard results in the expandable fluted corrugated strip 200 expanding to the expanded state, i.e. its original shape. This property is useful when used in the packing method discussed below. In this embodiment, the expandable fluted corrugated strip 200 may be collapsible (expandable) by a ratio of 5:1 or 6:1 relative to its expanded state.

Figure 6C:
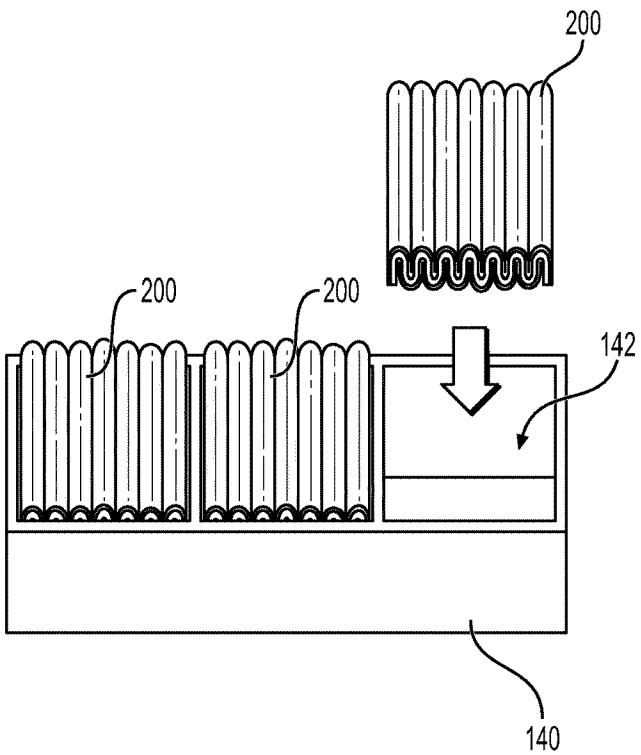
FIGS. 6A to 6C show a method of manufacturing the expandable fluted corrugated strip.
Figure 6B:
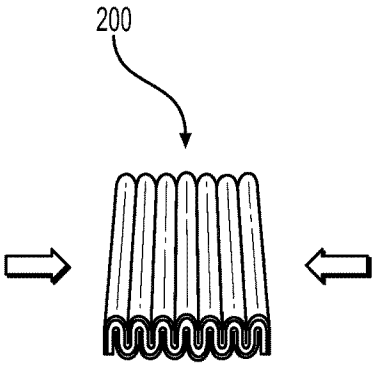
Figure 6A:
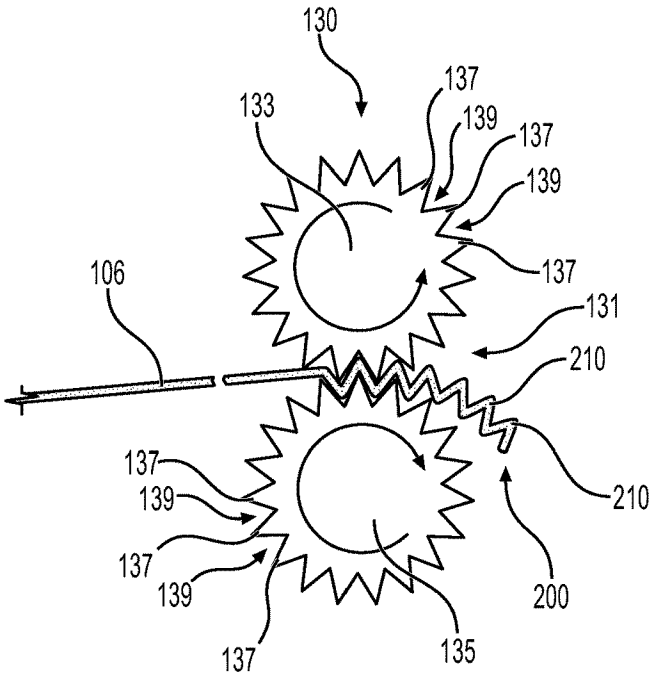

FIGS. 6A to 6C show a method of manufacturing the expandable fluted corrugated strip 200 of this embodiment. As shown in FIG. 6A, the corrugated stock material strip 106 is fed into a machine 130 from the left, and the macro flutes 210 are formed, in this embodiment, by passing the corrugated stock material strips 106 through a nip 131 formed between a first roller 133 and a second roller 135. Each of the first roller 133 and the second roller 135 includes a plurality of protrusions 137 and a plurality of recesses 139 that correspond to each other. The corrugated stock material strip 106 is shaped into the expandable fluted corrugated strip 200 as the corrugated stock material strip 106 moves through the nip 131. The protrusions 137 of the first roller 133 press the corrugated stock material strip 106 into corresponding recesses 139 of the second roller 135 with the corrugated material therebetween, and the protrusions 137 of the second roller 135 press the corrugated stock material strip 106 into corresponding recesses 139 of the first roller 133 with the corrugated material therebetween. In this manner the macro flutes 210 are formed in the corrugated stock material strip 106 forming the expandable fluted corrugated strip 200. Other suitable methods may be used to impress or otherwise form the flute 210 in the corrugated stock material strip 106.

The expandable fluted corrugated strip 200 is then compressed lengthwise into its compressed state, as shown in FIG. 6B, by applying a compression force to the expandable fluted corrugated strip 200 in the longitudinal direction. The compressed expandable fluted corrugated strip 200 can then be stored in a holder 140. The holder 140 of this embodiment includes a plurality of compartments 142. The holder 140 shown in FIG. 6C has three compartments 142, but the holder 140 may preferably include a large number of compartments 142. The compartments 142 are sized such that they hold the expandable fluted corrugated strip 200 in its compressed state. After being compressed, the expandable fluted corrugated strip 200 is placed into a compartment 142 of the holder 140, as shown in FIG. 6C. A plurality of expandable fluted corrugated strips 200 may be stored, with each expandable fluted corrugated strip 200 in its compressed state, in the holder 140.

Figure 7B:
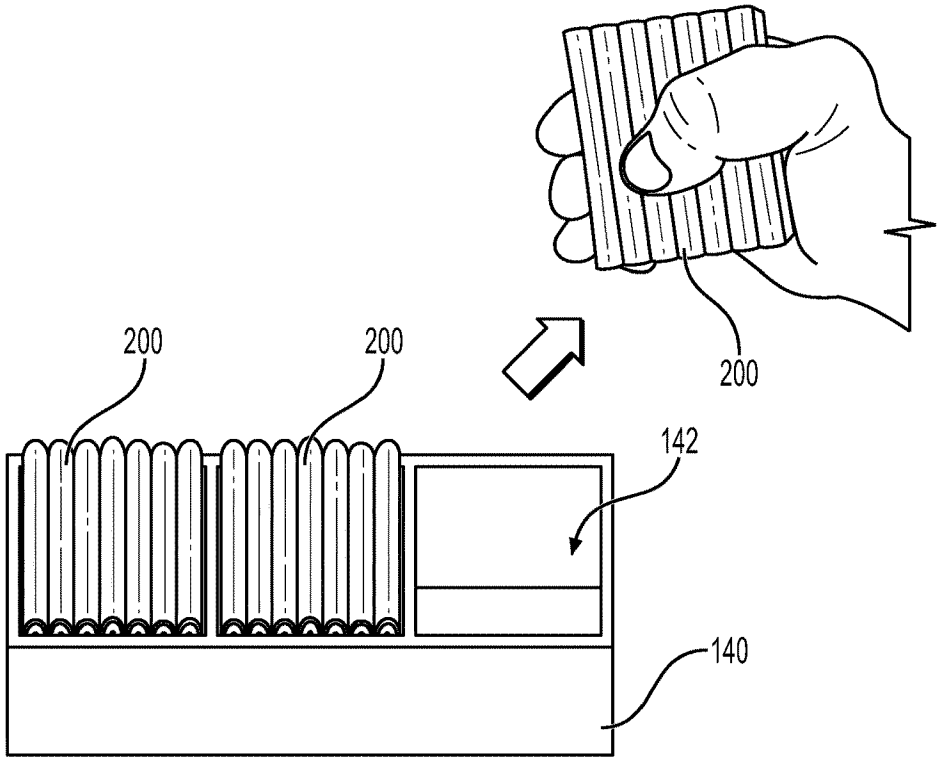
FIGS. 7A to 7E shows the expandable fluted corrugated strip used as a packing material.
Figure 7A:
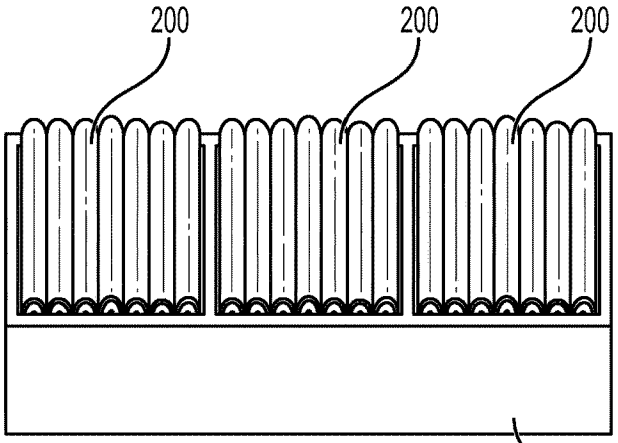
Figure 7C:
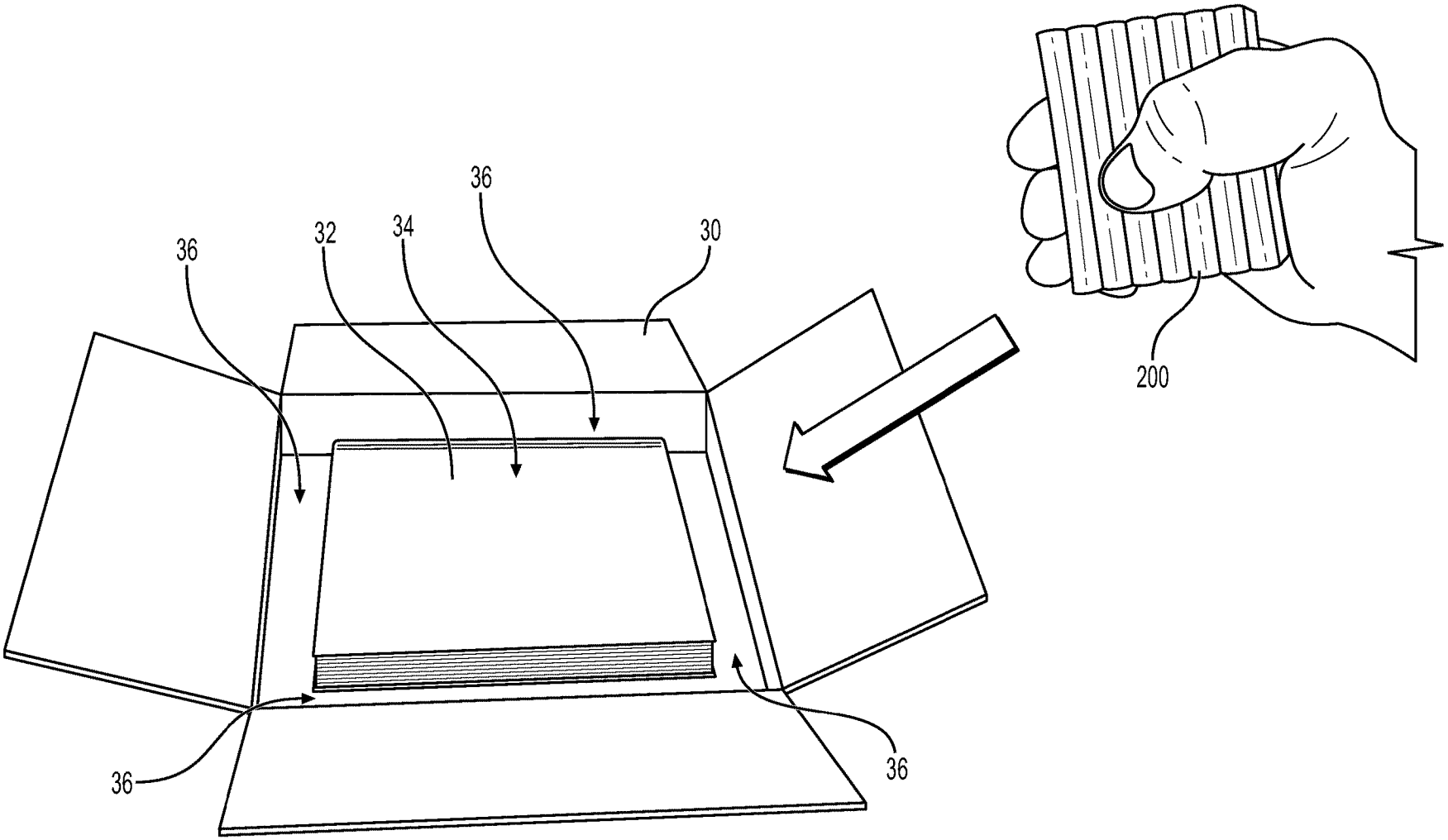

The holder 140 can then be moved to a fulfillment line. FIG. 7A shows a holder 140 filled with an expandable fluted corrugated strip 200 stored in the compressed state in each compartment 142 of the holder 140. As shown in FIG. 7B, the expandable fluted corrugated strip 200 can be pulled out of the holder 140 and, more specifically, the compartment 142 with an operator (or machine) maintaining the expandable fluted corrugated strip 200 in its compressed state. On a fulfillment line, an object to be shipped (referred to herein as an object 32) may be placed in a shipping container such as a shipping box 30. FIG. 7C show the shipping box 30 with the object 32 placed therein. The object 32 may be positioned within an interior 34 of the shipping box 30 with space 36 (or gaps) between the object 32 and the sides of the shipping box 30.

Figure 7D:
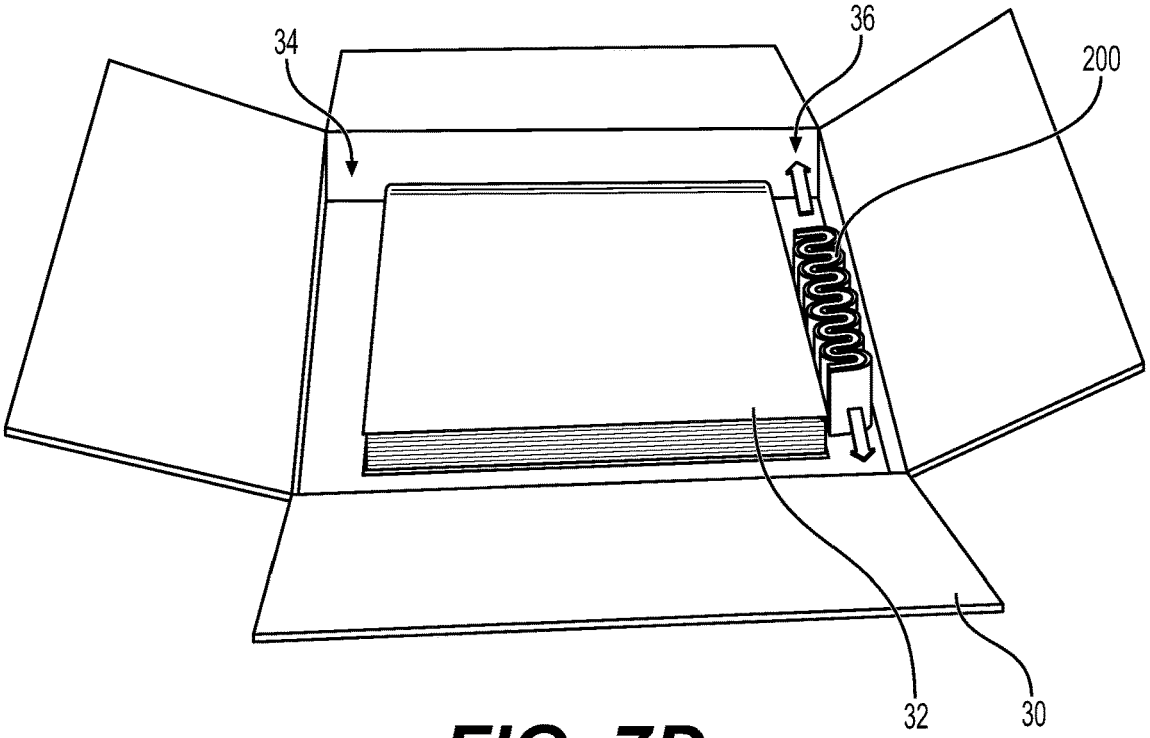
Figure 7E:
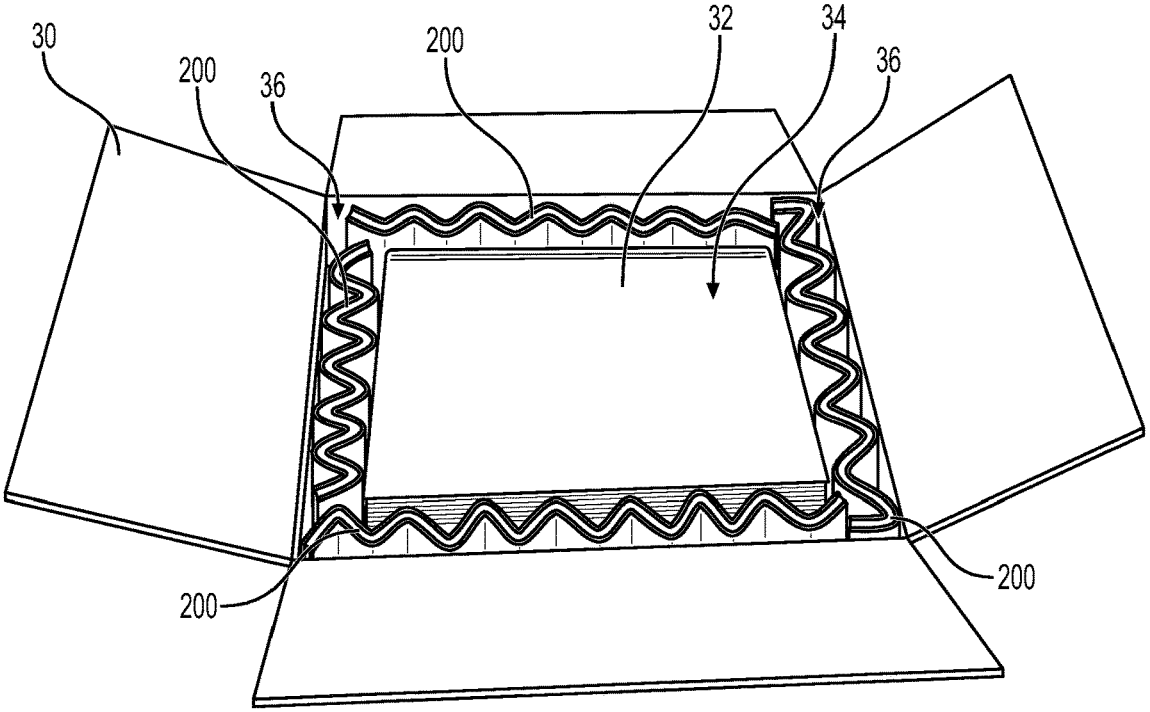

The expandable fluted corrugated strip 200 can be placed into the interior 34 of the shipping box 30 and, more specifically, into the space 36 between the object 32 and the sides of the shipping box 30. The expandable fluted corrugated strip 200 is placed into the space 36 while a compression force is applied to maintain the expandable fluted corrugated strip 200 in the compressed state. Then the compression force applied by the user (or machine) that places the expandable fluted corrugated strip 200 into the interior 34 of the shipping box 30 is released allowing the expandable fluted corrugated strip 200 to expand in the longitudinal direction towards its original shape. FIG. 7D shows the expandable fluted corrugated strip 200 expanding in the longitudinal direction to fill the space 36 between the object 32 and the sides of the shipping box 30. Although the expandable fluted corrugated strip 200 may fully expand to its original length, the expandable fluted corrugated strip 200 may still be compressed to some extent by the object 32 and the sides of the shipping box 30, for example, and thus be in an intermediate expanded state that is expanded relative to the compressed state. A particular advantage of the expandable fluted corrugated strip 200 is that this process of expanding and filling the void space 36 occurs by the elasticity of the expandable fluted corrugated strip 200 and does not require an external force or separate operation by a user to expand the expandable fluted corrugated strip 200. This process can then be repeated to fill any additional space 36 (or gaps) in the shipping box 30 as shown in FIG. 7E.

Figure 8:
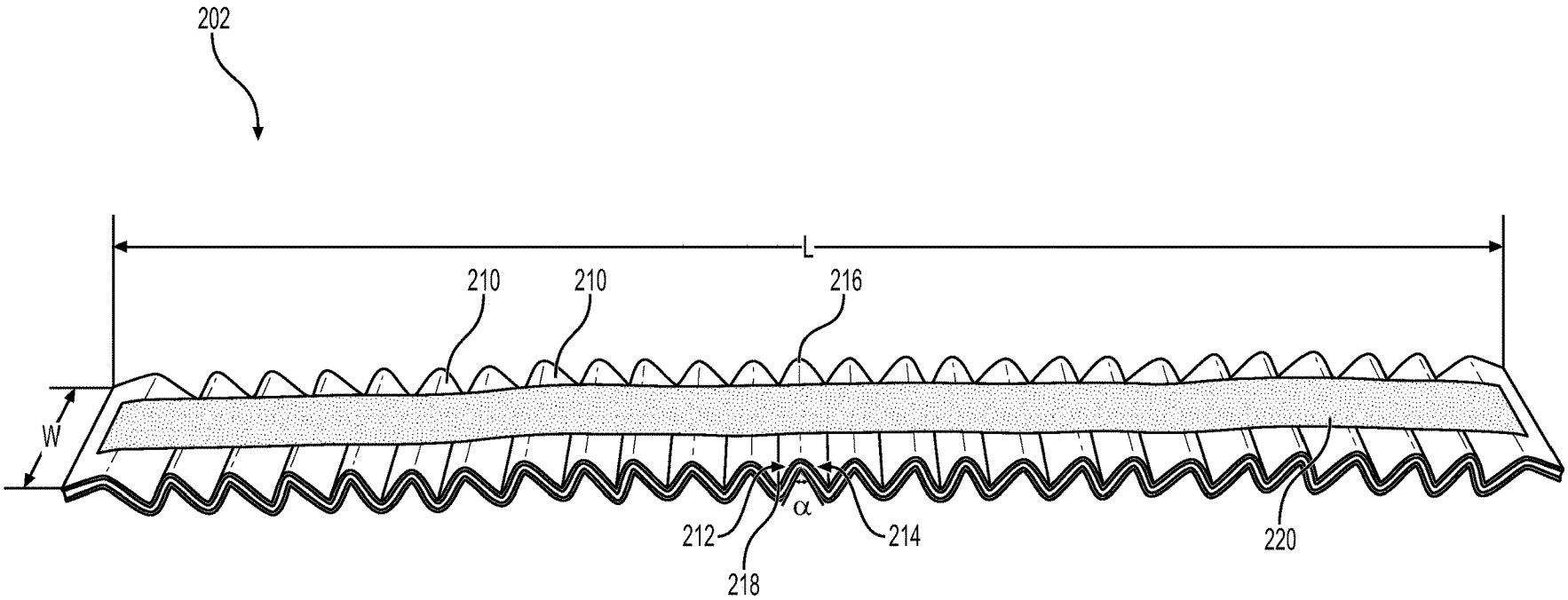
FIG. 8 shows a packing material (compressible fluted corrugated strip) according to a preferred embodiment the invention.

Another packing material is shown in FIG. 8. For clarity with the other packing materials discussed herein, the packing material of this embodiment is referred to as a compressible fluted corrugated strip 202. The compressible fluted corrugated strip 202 is similar to the expandable fluted corrugated strip 200, discussed above. The discussion of the expandable fluted corrugated strip 200 applies to the compressible fluted corrugated strip 202, and the same reference numerals used above for the expandable fluted corrugated strip 200 will be used for the same or similar features of the compressible fluted corrugated strip 202.

The compressible fluted corrugated strip 202, however, includes a sheet 220 attached to each end of the compressible fluted corrugated strip 202. The sheet 220 may be formed of a cellulosic material, such as paper, to be biodegradable. The sheet 220 may be attached to the compressible fluted corrugated strip 202 using any suitable means, in this embodiment, the sheet 220 is adhered to each end of the compressible fluted corrugated strip 202 using an adhesive. Any suitable adhesive 136 may be used, but in this embodiment and throughout the embodiments discussed herein, the adhesive 136 is preferably a biodegradable adhesive. In some embodiments, the sheet 220 may also be attached to the peaks 216 of at least some of the macro flutes 210. The sheet 220 may be attached to the peak 216 of the flute 210 by an adhesive. By use of the sheet 220, the compressible fluted corrugated strip 202 is preferably maintained in a less than fully expanded position that would otherwise occur as a result of the elasticity of the compressible fluted corrugated strip 202, but it could also function with the corrugated strip in a fully expanded position. As discussed below, the sheet 220 helps to maintain the of the integrity macro flutes 210 when a force is applied in a thickness direction of the compressible fluted corrugated strip 202. The thickness direction is a direction orthogonal to both the width and length direction. The sheet also serves to limit the expandability of the corrugated strip without limiting its compressibility.

Figure 9:
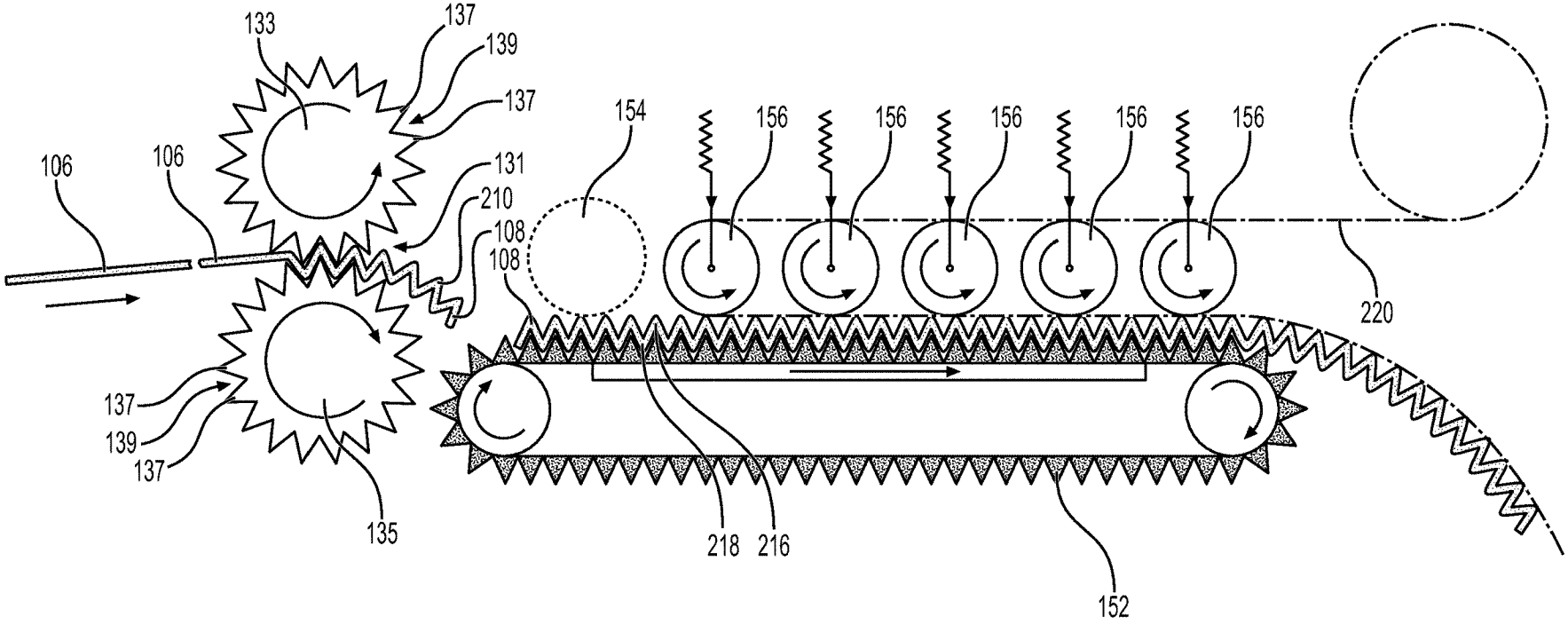
FIG. 9 shows a machine used to form the fluted corrugated strip shown in FIG. 8.

FIG. 9 shows a method of manufacturing the compressible fluted corrugated strip 202 of this embodiment. The macro flutes 210 of this embodiment may be formed in the manner discussed above with reference to FIG. 6A by passing corrugated stock material strips 106 through a nip 131 formed between a first roller 133 and a second roller 135. The corrugated stock material strip 106 after having the macro flutes 210 formed therein is referred to herein as a fluted stock strip 108. The fluted stock strip 108 is then conveyed by a conveyor 152. The conveyor 152 may have protrusions and recesses that correspond to the peaks 216 and valleys 218 of the fluted stock strip 108. In this embodiment, the adhesive is applied to each peak 216 by an adhesive roller 154 but other suitable methods may be used to apply the adhesive to the fluted stock strip 108. The sheet 220 is then applied to peaks 216 and pressed against the peak 216 by a plurality of compression rollers 156. Other suitable methods may be used to attach the sheet 220 to the fluted stock strip 108. For example, the sheet 220 may be a tape having the adhesive applied to an underside of the sheet 220. The sheet 220 may have a pre-cut length or the sheet 220 may be subsequently cut to separate the fluted corrugated strips 202.

The compressible fluted corrugated strip 202 is compressible. The compressible fluted corrugated strip 202 may be placed into the interior 34 of the shipping box 30 and then the object 32 may be placed therein with the compressible fluted corrugated strip 202 being compressed in the longitudinal direction between the object 32 and the sides of the shipping box 30. In such a way, the compressible fluted corrugated strip 202 may be used in a manner similar to the expandable fluted corrugated strip 200 discussed above, but with the compressible fluted corrugated strip 202 placed into the shipping box 30 before the object 32 or being compressed by the shipping box 30 when it is closed. The compressible fluted corrugated strip 202 is compressible (collapsible) by, as a non-limiting example, a ratio of 2:1 or 3:1 relative to its expanded state.

Figure 10:
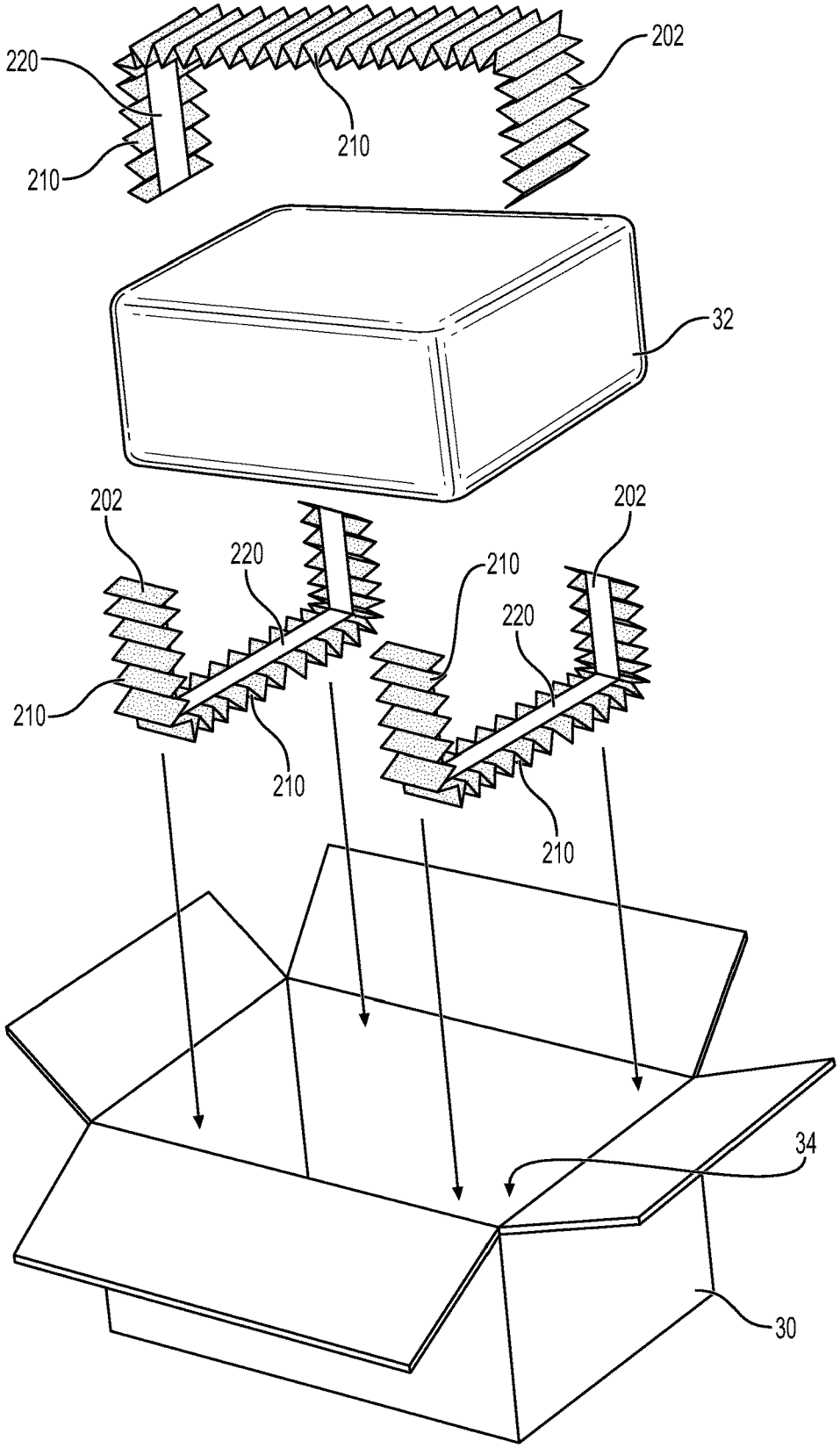
FIG. 10 is an exploded view of a package using the fluted corrugated strip as the packing material.

The compressible fluted corrugated strip 202 may be used as a packing material in other ways. FIG. 10 is an exploded view of a package using the compressible fluted corrugated strip 202 as the packing material. Here, strips of the compressible fluted corrugated strip 202 may be placed into the shipping box 30 and then the object 32 placed on top of the compressible fluted corrugated strip 202. The compressible fluted corrugated strip 202 may preferably be sized such that the strip not only spans the width of the bottom of the shipping box 30 but also extends upwards along the sides of the shipping box 30. Additional fluted corrugated strips 202 may then be placed on top of the object 32 with a length of the compressible fluted corrugated strip 202 such that the compressible fluted corrugated strip 202 spans the length of the shipping box 30 and extends downward along the sides of the shipping box 30. In such a manner a plurality of fluted corrugated strips 202 may be used to wrap the object 32. With the compressible fluted corrugated strip 202 positioned around the object 32 in this manner, the object 32 may press on the compressible fluted corrugated strip 202 in a direction that would tend to flatten or reduce the height of the macro flutes 210 of the fluted corrugated strip 202. The sheet 220 attached to at least each of the first end and the second end of the compressible fluted corrugated strip 202 helps prevent the compressible fluted corrugated strip 202 from being expanded in length and thus is helps retain the structural integrity of the macro flutes 210.

Figure 11A:
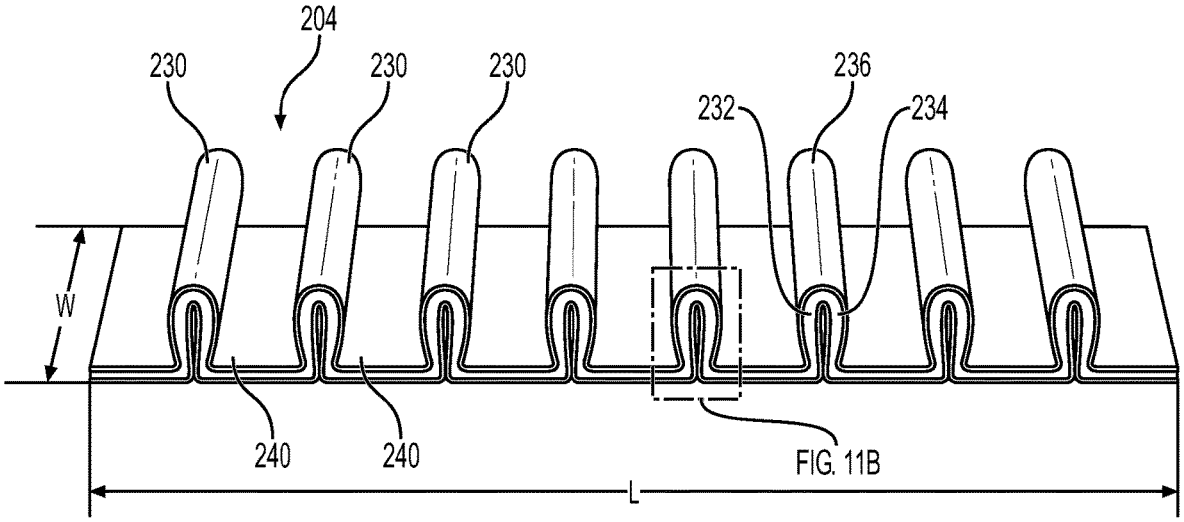
FIGS. 11A to 11C shows a packing material (finned corrugated strip) according to a preferred embodiment of the invention.
Figure 11B:
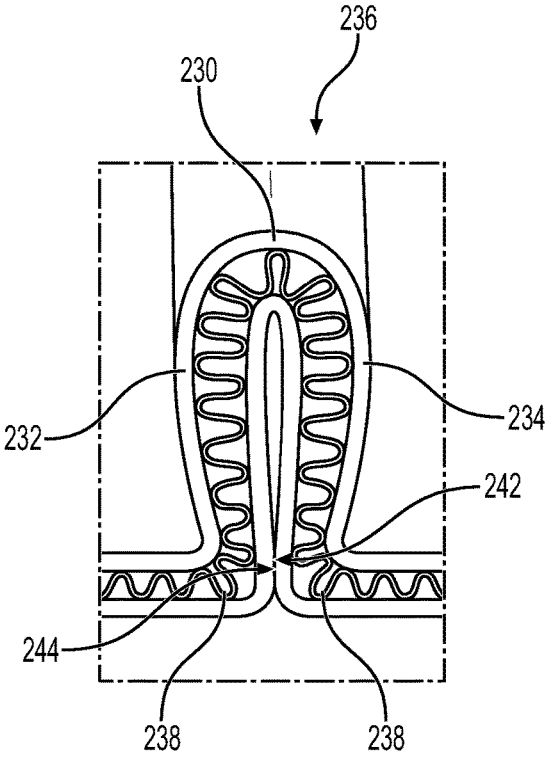

Another packing material formed from the corrugated stock material strip 106 is shown in FIGS. 11A and 11B. For clarity with the other packing materials discussed herein, the packing material of this embodiment is referred to as a finned corrugated strip 204. FIG. 11A is a perspective view of the finned corrugated strip 204, and FIG. 11B is a detail view, showing detail 11B in FIG. 11A, of the finned corrugated strip 204. The finned corrugated strip 204 includes a plurality of fins 230 that are arranged parallel to each other. In this embodiment, the fins 230 of the finned corrugated strip 204 are parallel to the interior flutes of the corrugated material (e.g., the interior flutes of the corrugated sheet 16 shown in FIG. 1A) used to form the finned corrugated strip 204. Like the expandable fluted corrugated strip 200 discussed above, the finned corrugated strip 204 includes a length L and a width W, with the length L of the finned corrugated strip 204 being greater than the width W. The finned corrugated strip 204 includes a longitudinal direction that is in the length direction of the expandable fluted corrugated strip 200. Each fin 230 of this embodiment is oriented transverse to a longitudinal direction and, more specifically, perpendicular to the longitudinal direction such that the fins 230 are oriented in the width direction W of the finned corrugated strip 204.

In this embodiment, the fins 230 are separated from each other by a base section 240 of the finned corrugated strip 204. The base section 240 is generally planar in this embodiment and each of the fins 230 is connected to a base section 240. The fins 230 project from the base section 240. In this embodiment, all of the fins 230 project in the same direction such that all of the fins 230 are on the same side of the finned corrugated strip 204, but in other embodiments the fins 230 may project in opposite directions from the base section 240 such that some of the fins 230 are on each side of the finned corrugated strip 204.

As shown in FIG. 11B, the fins 230 of this embodiment have a U-shape or a horseshoe shape, and each fin 230 includes a first projecting portion 232 connected to a second projecting portion 234 at a peak 236. The end of each of the first projecting portion 232 and the second projecting portion 234 that is connected to the base section 240 is a base end portion 238. The base end portion 238 is the end of the first projecting portion 232 or the second projecting portion 234 opposite the peak 236. In this embodiment, the first projecting portion 232 and the second projecting portion 234 are continuously connected to each other at the peak 236 and are a continuation of the same corrugated material at the peak 236 without being cut or separated.

Other portions of the first projecting portion 232 and the second projecting portion 234 (beyond the peak 236) may also be connected to each other. For example, an adhesive may be applied between an interior surface 242 of the first projecting portion 232 and an interior surface 244 of the second projecting portion 234. Although the adhesive may be applied to the full length of the interior surface 242 of the first projecting portion 232 and/or the interior surface 244 of the second projecting portion 234, the adhesive in this embodiment is applied between the base end portion 238 of the interior surface 242 of the first projecting portion 232 and/or the interior surface 244. In this way, the first projecting portion 232 and the second projecting portion 234 is also connected to each other at the base end portion 238. Connecting the first projecting portion 232 and the second projecting portion 234 at the base end portion 238 helps prevent the fin 230 from spreading out when a force is applied to the peak 236, for example, and thus provides rigidity to the fin 230 and a protective (cushioning) effect of the finned corrugated strip 204 overall.

Figure 11C:
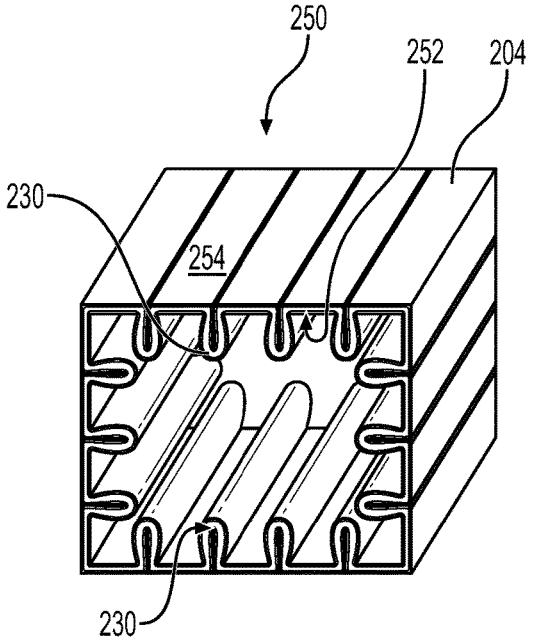

The finned corrugated strip 204 may be used as a packing material within a shipping box 30 such as in the manner discussed above for the compressible fluted corrugated strip 202. In some embodiments, however, the finned corrugated strip 204 may be formed into the packaging material itself or the fins 230 are otherwise integrally formed with the side walls of the shipping box. FIG. 11C shows the finned corrugated strip 204 shaped into four sides of a packaging material 250. One end of the finned corrugated strip 204 may be attached to the other end of the finned corrugated strip 204, such as by using adhesive, to form the packaging material 250. The packaging material 250 includes interior surfaces 252 and exterior surfaces 254. The fins 230 are located on the interior surfaces 252 to project into the interior of the packaging material 250 where the object 32 can be placed. In some embodiments, a sheet, such as a cellulosic sheet (e.g., paper), may be adhered or otherwise attached to the exterior surfaces 254.

Figure 12B:
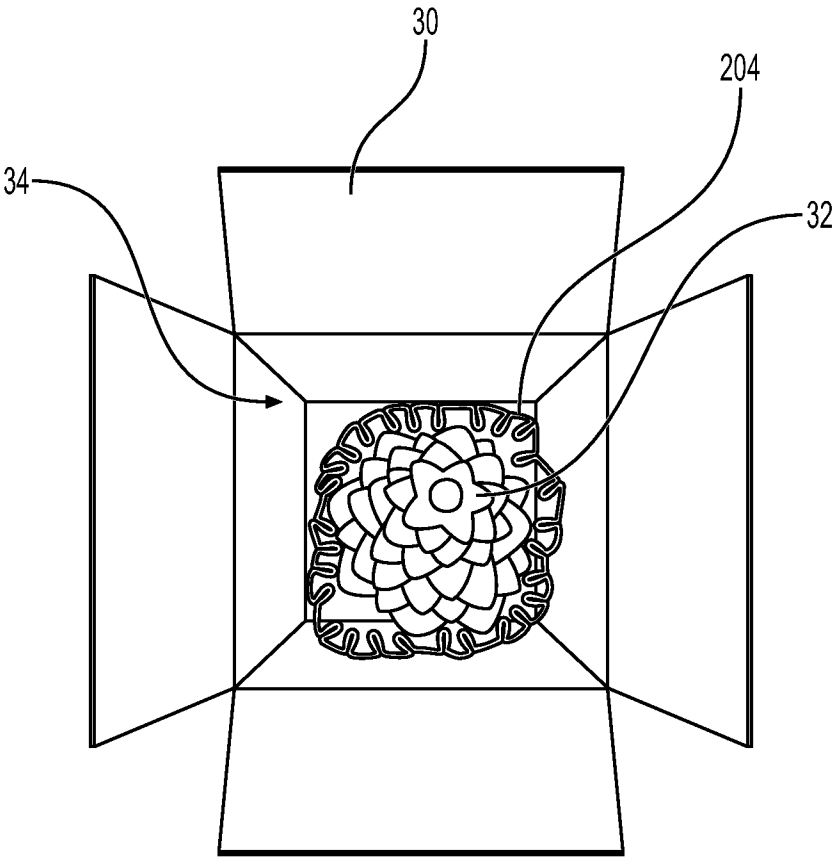
FIGS. 12A to 12D show a packing sequence for an irregularly shaped object-to-be-shipped using the finned corrugated strip.
Figure 12A:
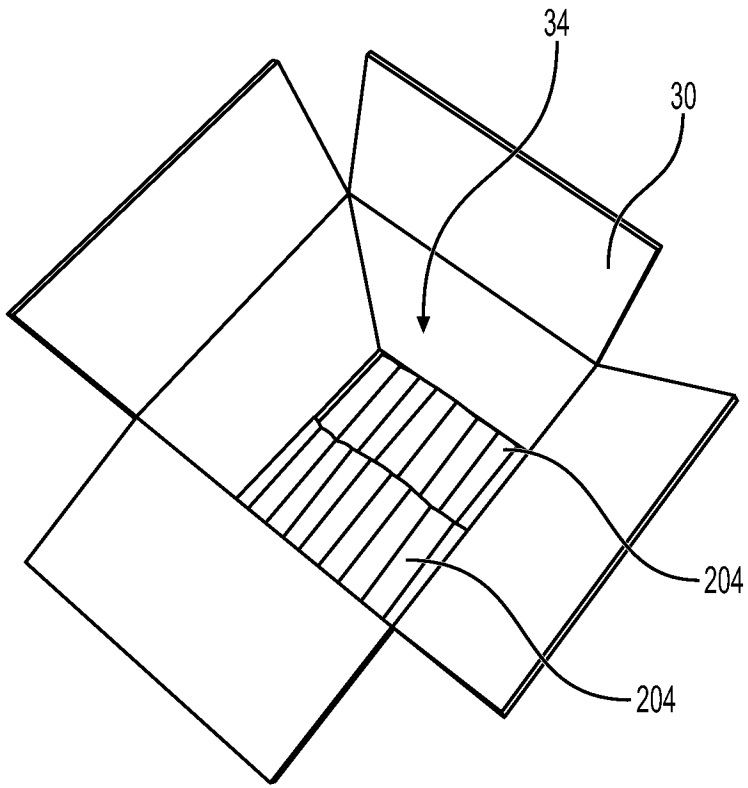

FIGS. 12A to 12D show a packing sequence for an irregularly shaped object 32 using the finned corrugated strip 204. The finned corrugated strip 204 may initially be placed in the bottom of the shipping box 30, as shown in FIG. 12A. The fins 230 of the finned corrugated strip 204 are facing downward towards the exterior of the shipping box 30 in this figure, but the finned corrugated strip 204 could be orientated so the fins 230 are facing inward toward the object 32.

As shown in FIG. 12B, the object 32, which in this embodiment is irregularly shaped, is placed into the interior 34 of the shipping box 30. Here, at least one finned corrugated strip 204 is wrapped around the object 32 before it is placed into the interior 34. The finned corrugated strip 204 is positioned with the fins 230 facing toward the object 32, but the fins 230 may be positioned facing the sidewalls of the shipping box 30, instead.

Figure 12D:
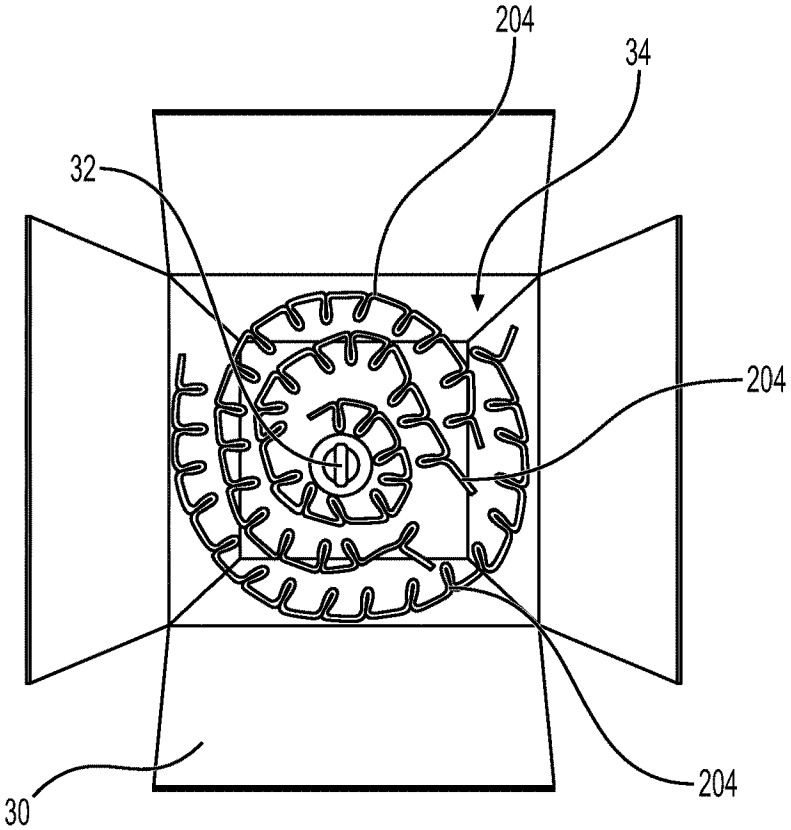
Figure 12C:
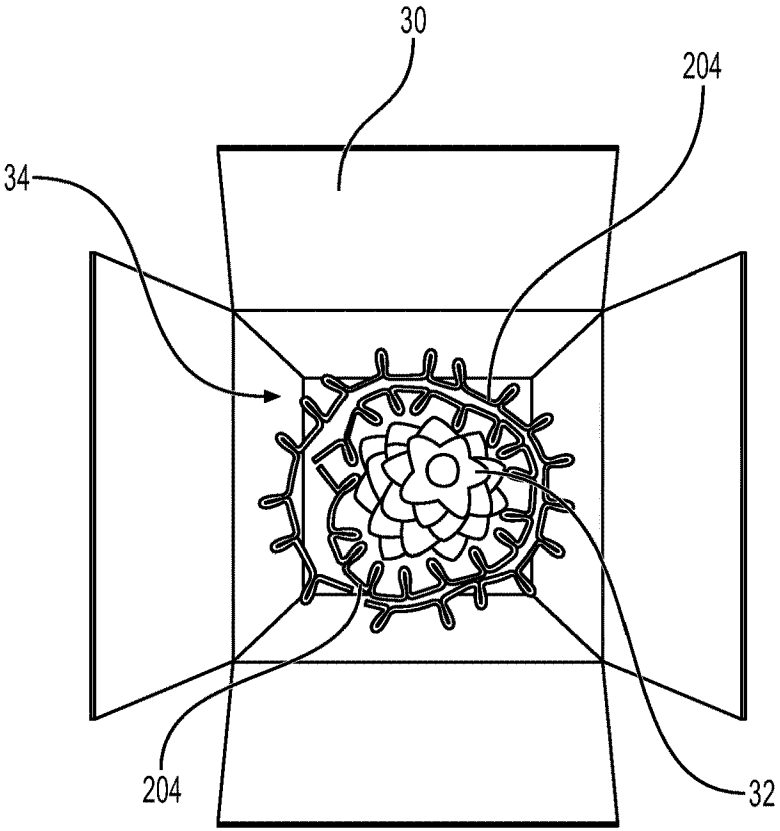

In this embodiment, the object 32 is wider at the bottom (base) than it is at the top. In FIG. 12C, additional finned corrugated strips 204 are wrapped around the object 32 and placed in the interior 34 of the shipping box 30. This figure shows an inner finned corrugated strip 204 nested within an outer finned corrugated strip 204 between the object 32 and the outer finned corrugated strip 204. Here the inner finned corrugated strip 204 is positioned with the fins 230 facing the object 32 and the outer finned corrugated strip 204 is positioned with the fins 230 facing the sidewalls of the shipping box 30. FIG. 12D shows additional finned corrugated strips 204 wrapped around and above the object 32 to fill the remainder of the interior 34 of the shipping box 30. Although FIGS. 12A to 12D show the finned corrugated strip 204, the compressible fluted corrugated strip 202 may also be used in this way.

Figure 13:
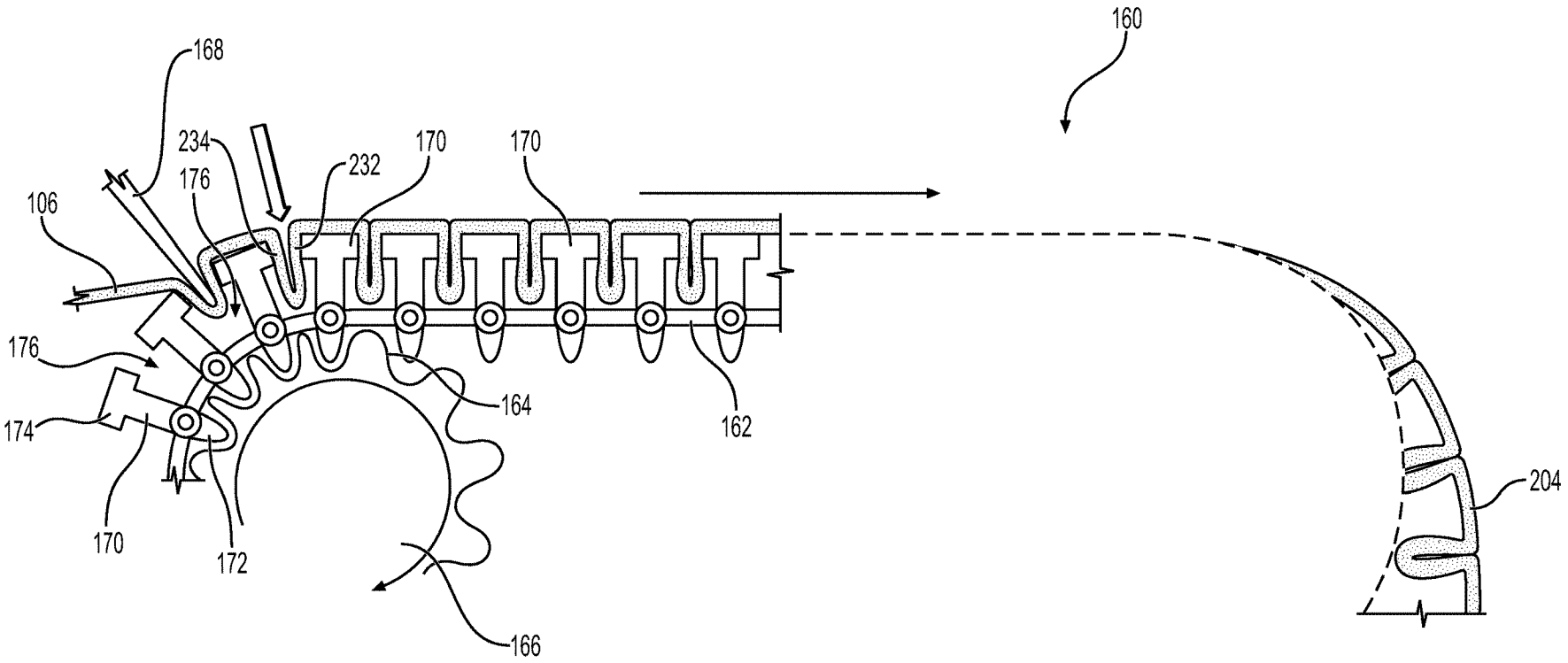
FIG. 13 shows a machine used to form the finned corrugated strip.

FIG. 13 shows a machine 160 that may be used to form the finned corrugated strip 204 from the corrugated stock material strip 106. The machine 160 includes a plurality of T-shaped clamps 170 that are each pivotably attached to a carrier 162. Each clamp 170 includes an interior end 172 and an exterior end 174, with the crossbar of the T-shape being located on the exterior end 174. The interior end 172 of the clamp 170 engages with the sprockets 164 of a gear 166. As the clamp 170 rotates around the gear 166 (e.g., from the 9 o'clock position toward the 12 o'clock position in FIG. 13), the exterior end 174 of adjacent clamps 170 are spaced apart from each other allowing the corrugated stock material strip 106 to be pressed into a cavity 176 formed between adjacent clamps 170. In this embodiment, the corrugated stock material strip 106 is pressed into the cavity 176 by a plunger 168. After the corrugated stock material strip 106 is pressed into the cavity 176, the adhesive is applied to the interior surfaces 242, 246 of the first and second projecting portion 232, 234. Then adjacent clamps 170 are brought together such that the interior surfaces 242, 246 of the first and second projecting portion 232, 234 abut each other as the adhesive cures. The interior end 172 of the clamp 170 disengages from the sprockets 164 of the gear 166 after adjacent clamps are brought together. The process may then be reversed by another gear with sprockets (not shown) to release the clamp 170. Other suitable methods may be used to release the clamp 170. This is one example of forming the finned corrugated strip 204 and other suitable methods may be used.

Figure 14A:
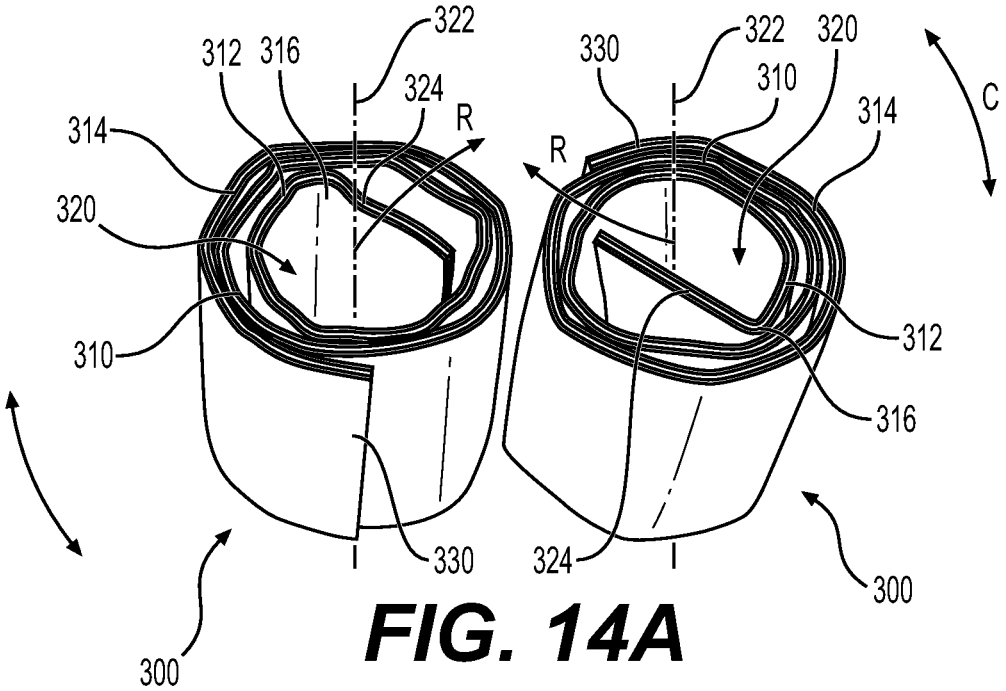
FIGS. 14A and 14B each shows a packing material (coiled corrugated cellulosic cushioning element) according to other preferred embodiments of the invention.

FIG. 14A shows packing material according to another embodiment. For clarity with the other packing materials discussed herein, the packing material of this embodiment is referred to as a coiled corrugated cellulosic cushioning element 300. As will be discussed further below, the coiled corrugated cellulosic cushioning element 300 is a coiled strip of corrugated cellulosic material and, more specifically, the corrugated stock material strip 106 that has been coiled. The coiled corrugated cellulosic cushioning element 300 includes at least one winding 310, and in the embodiment shown in FIG. 14A, the coiled corrugated cellulosic cushioning element 300 includes a plurality of windings 310 including an innermost winding 312 and an outermost winding 314.

The coiled corrugated cellulosic cushioning element 300 has a circumferential direction C and a radial direction R. As will be discussed further below, the coiled corrugated cellulosic cushioning element 300 is wound in the circumferential direction C and includes a central axis 322. The central axis 322 extends in a central axis direction, which in this embodiment is perpendicular to the circumferential direction C. The coiled corrugated cellulosic cushioning element 300 is wound such that the plurality of interior flutes of the corrugated cellulosic sheet (e.g., corrugated sheet 16 in FIG. 1A) are oriented in the central axis direction.

The coiled corrugated cellulosic cushioning element 300 is also annular with a central opening 320. The innermost winding 312 defines the central opening 320, and the central axis 322 may extend through the central opening 320. The innermost winding 312 may include a winding initiation portion 316 where the innermost winding 312 begins. In some embodiments, a projection portion 324 projects from the winding initiation portion 316 into the central opening 320, and in this embodiment, the projection portion 324 projects into the central opening 320 by more than a radius of the central opening 320.

The coiled corrugated cellulosic cushioning element 300 may be used as a packing material in a manner similar to the expandable fluted corrugated strip 200 discussed above where the coiled corrugated cellulosic cushioning element 300 is compressed and placed in the space 36 between the object 32 and the shipping box 30. The coiled corrugated cellulosic cushioning element 300 may also be used like the corrugated cellulosic cushioning elements 400, 402, discussed below with reference to FIG. 22.

Figure 14B:
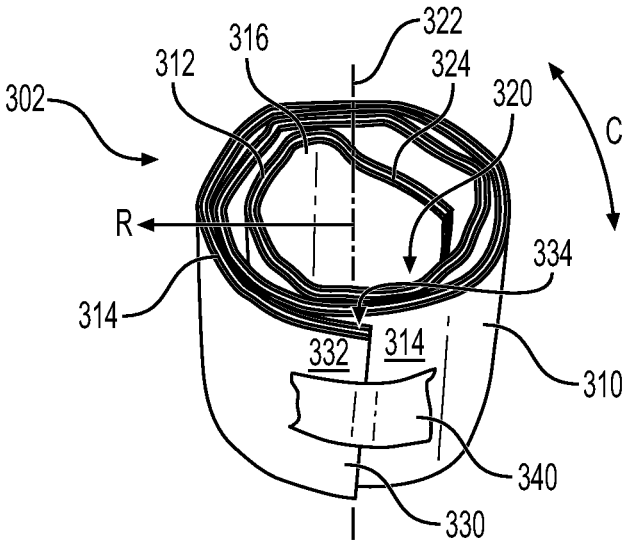

The outermost winding 314 also includes an end portion 330. In the embodiment shown in FIG. 14A, the end portion 330 is free, but in some embodiments the end portion 330 may be attached to an adjacent winding 310. FIG. 14B shows a coiled corrugated cellulosic cushioning element 302 with the end portion 330 attached to an adjacent winding 310. In this embodiment, the end portion 330 is attached to an outward-facing surface 318 of the adjacent winding 310 by a piece of tape 340. The tape 340 is adhered to an outward-facing surface 332 of the end portion 330 and the outward-facing surface 318 of the adjacent winding 310. Other suitable means may be used to attach the end portion 330 to the adjacent winding 310. For example, an adhesive may be applied to an inward-facing surface 334 of the end portion 330, and the adhesive affixes the inward-facing surface 334 of the outer end portion 330 to the outward-facing surface 318 of the adjacent winding 310.

Figure 15A:
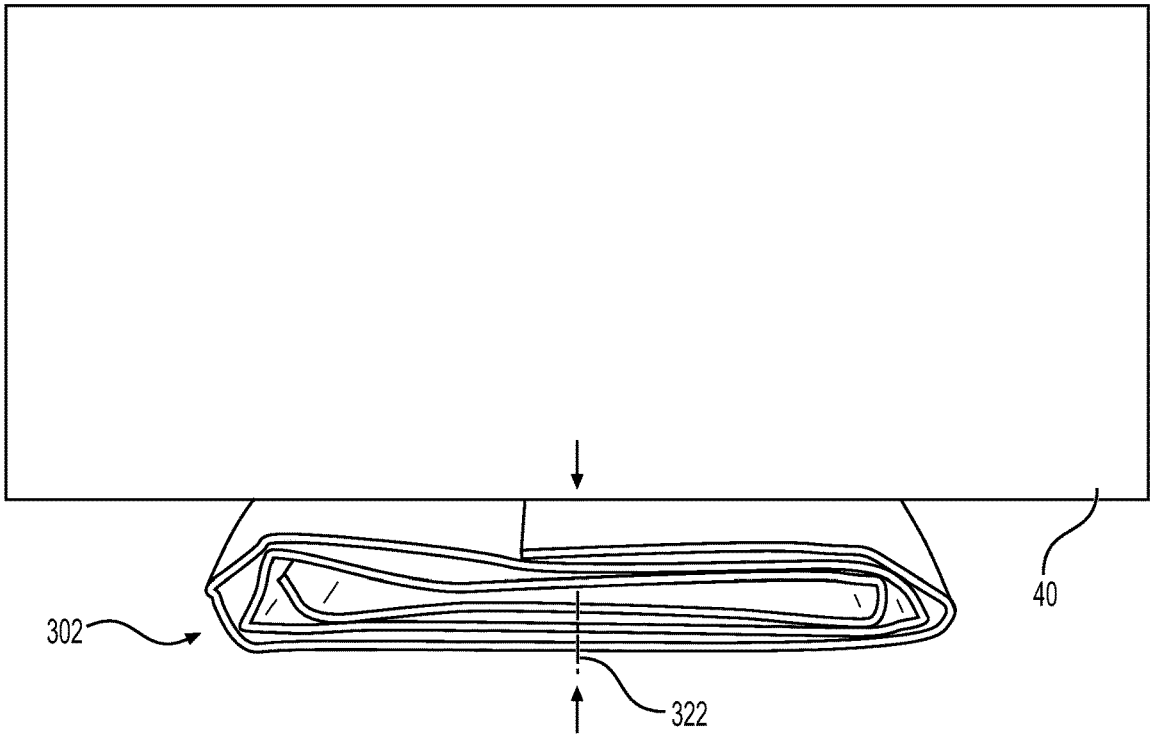
FIGS. 15A and 15B show the effect of placing and removing a mass on the coiled corrugated cellulosic cushioning element shown in FIG. 14B.
Figure 15B:
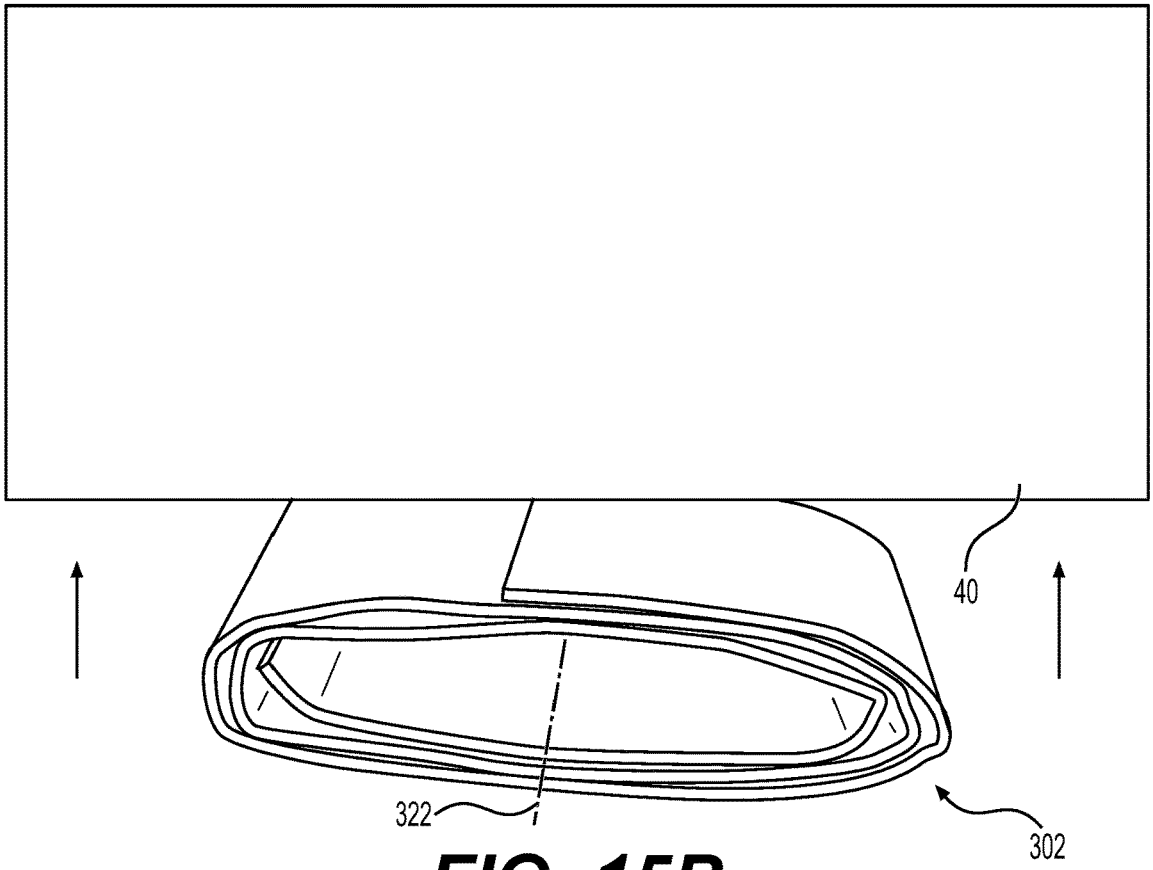

FIG. 15A shows an example of a mass 40 placed on the coiled corrugated cellulosic cushioning element 302 to compress the coiled corrugated cellulosic cushioning element 302 in the radial direction R and in a direction perpendicular to the central axis 322. Even in this compressed state, the coiled corrugated cellulosic cushioning element 302 retains some cushioning effect. FIG. 15B shows the mass 40 being lifted upward to release the compressive force applied to the coiled corrugated cellulosic cushioning element 302. With the coiled corrugated cellulosic cushioning element 302 being formed from corrugated cellulosic materials (such as single-walled corrugated fiberboard 10 shown in FIG. 1A or double-walled corrugated fiberboard 20 shown in FIG. 1B), the elasticity of the corrugated cellulosic materials allows the coiled corrugated cellulosic cushioning element 302 to regain some of its shape and maintain at least some of its original cushioning effect even after being compressed. Securing the coiled corrugated cellulosic cushioning element 302 with different numbers of windings (or spirals) can be used to adjust the size and shape of the coiled corrugated cellulosic cushioning element 302. Adjusting the size and shape of the coiled corrugated cellulosic cushioning element 302 can be used to vary the bounce or compressibility and rigidity of the coiled corrugated cellulosic cushioning element 302. Although this discussion applies to the coiled corrugated cellulosic cushioning element 300, attaching the end portion 330 as in the coiled corrugated cellulosic cushioning element 302 may allow the coiled corrugated cellulosic cushioning element 302 to have tighter and more windings 310 increasing the rigidity and elasticity of the coiled corrugated cellulosic cushioning element 302.

The coiled corrugated cellulosic cushioning element 302 is otherwise similar to the coiled corrugated cellulosic cushioning element 300, discussed above. The discussion of the coiled corrugated cellulosic cushioning element 300 applies to the coiled corrugated cellulosic cushioning element 302, and the same reference numerals used for the coiled corrugated cellulosic cushioning element 300 are used for the same or similar features of the coiled corrugated cellulosic cushioning element 302.

Figure 16A:
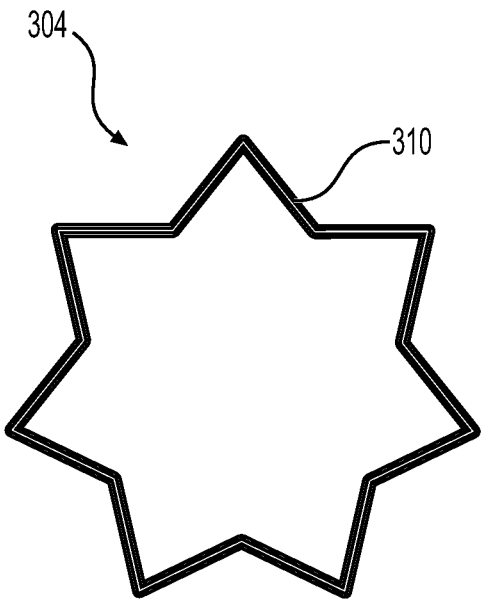
FIGS. 16A and 16B each shows a packing material according to other preferred embodiments the invention.
Figure 16B:
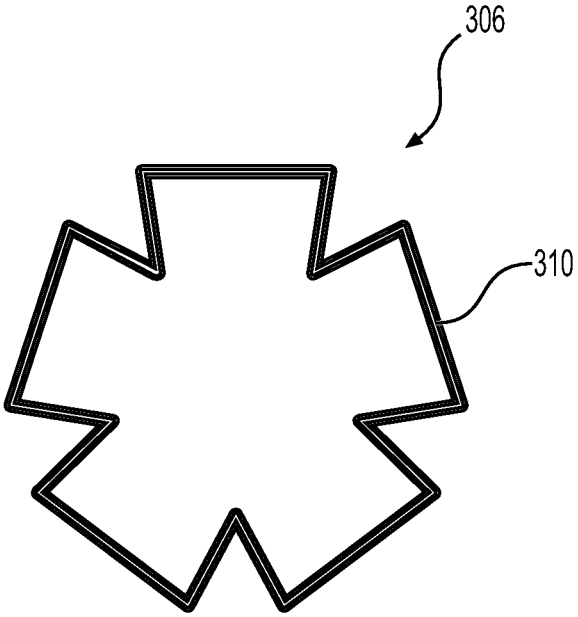

The coiled corrugated cellulosic cushioning elements 300, 302 shown in FIGS. 14A and 14B have a cylindrical shape that is generally a right circular cylinder. The corrugated cellulosic cushioning elements 300, 302, whether having multiple winding 310 or not, may have shapes. FIGS. 16A and 16B show coiled corrugated cellulosic cushioning elements 304, 306 having alternate shapes, for example. The coiled corrugated cellulosic cushioning element 304 shown in FIG. 16A has triangular projections, and the coiled corrugated cellulosic cushioning element 306 shown in FIG. 16B has rectangular or trapezoidal projections. The coiled corrugated cellulosic cushioning elements 304, 306 shown in FIGS. 16A and 16B are otherwise similar to the coiled corrugated cellulosic cushioning elements 300, 302, discussed above. The discussion of the coiled corrugated cellulosic cushioning elements 300, 302 applies to the coiled corrugated cellulosic cushioning elements 304, 306 of this embodiment and the same reference numerals used for the coiled corrugated cellulosic cushioning elements 300, 302 are used for the same or similar features of the coiled corrugated cellulosic cushioning elements 304, 306.

FIGS. 17A to 20B show a method and a machine 350 used to form the coiled corrugated cellulosic cushioning element 300 and the coiled corrugated cellulosic cushioning element 302 discussed herein. FIGS. 17A, 18A, 19A, and 20A show one side view of the machine 350, and FIGS. 17B, 18B, 19B, and 20B show another side view of the machine 350.

FIGS. 17A and 17B illustrate a first step. The machine 350 includes a spindle 360 having a slot 362 formed therein. In the first step, the corrugated stock material strip 106 is fed into the slot 362 of the spindle 360. The portion of the corrugated stock material strip 106 inserted into the slot 362 forms the projection portion 324 of the coiled corrugated cellulosic cushioning element 300.

FIGS. 18A and 18B illustrate a second step. In the second step, the spindle 360 is rotated while the corrugated stock material strip 106 is fed in a direction toward the corrugated stock material strip 106. The corrugated stock material strip 106 is thus wrapped around the spindle 360 forming the windings 310 of the coiled corrugated cellulosic cushioning element 300. The spindle 360 is rotated for the number of windings 310 desired for the coiled corrugated cellulosic cushioning element 300. The machine 350 may also include a tension roller 352 that applies a compressive force in the radial direction of the spindle 360. As the spindle 360 rotates the tension roller 352 applies the compressive force to the corrugated stock material strip 106 to help form the windings 310. The machine 350 may also include an adhesive applicator 354 that applies an adhesive to the outward-facing surface 318 of the adjacent winding to adhere the end portion 330 (see FIG. 19A) to the adjacent winding 310 when forming the coiled corrugated cellulosic cushioning element 302 discussed above. In some embodiments, the adhesive applicator 354 may be a roller and the adhesive may be applied between each winding 310 if so desired.

FIGS. 19A and 19B illustrate a third step. The machine 350 further includes a knife 356, and in the third step, the knife 356 is used to cut the corrugated stock material strip 106 as the spindle 360 continues to rotate. In some embodiments, where the corrugated stock material strip 106 is already a suitable length for the coiled corrugated cellulosic cushioning element 300, this step may be omitted.

FIGS. 20A and 20B illustrate a fourth step. The machine 350 also includes an ejector 364, which in this embodiment is a collar fitted around the spindle 360. In step four, the ejector 364 is moved in an axial direction of the spindle 360 to push the coiled corrugated cellulosic cushioning element 300 off of the spindle 360. In some embodiments, a tube 358 sized to accommodate the coiled corrugated cellulosic cushioning element 300 is positioned adjacent to the spindle 360. The ejector 364 may be used to push the coiled corrugated cellulosic cushioning element 300 into the interior of the tube 358. The tube 358 may be used to retain the coiled corrugated cellulosic cushioning element 300 in the desired shape as the adhesive cures.

Figure 21A:
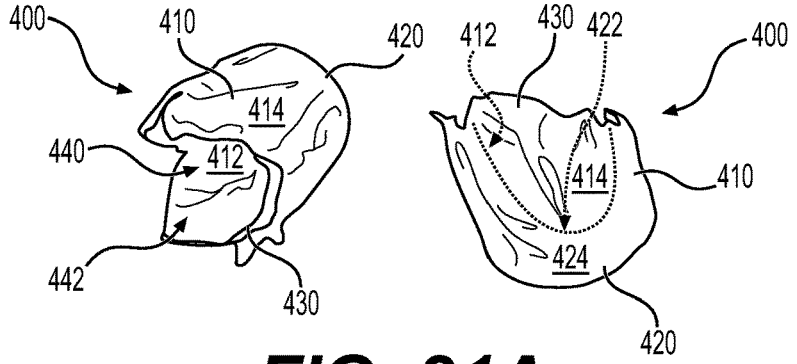
FIGS. 21A and 21B each shows a packing material according to other preferred embodiments the invention.
Figure 21B:
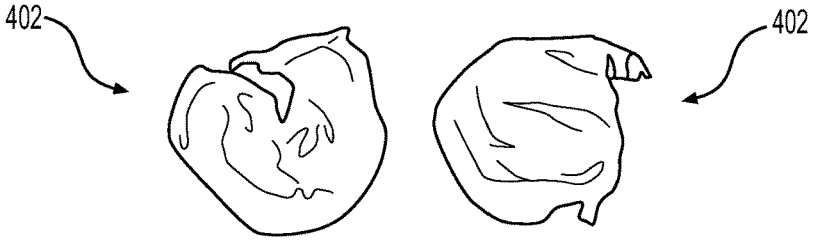

FIGS. 21A and 21B show packing materials according to another embodiment. For clarity with the other packing materials discussed herein, the packing material shown in FIG. 21A is referred to as a cupped corrugated cellulosic cushioning element 400, and the packing material shown in FIG. 21B is referred to as a balled corrugated cellulosic cushioning element 402. As will be discussed further below, the corrugated stock material strip 106 is sectioned and then compressed into either a cup shape (the cupped corrugated cellulosic cushioning element 400) or a ball-like (generally spherical) shape (the balled corrugated cellulosic cushioning element 402).

The cupped corrugated cellulosic cushioning element 400 shown in FIG. 21A has a substantially cylindrical shape with a side wall 410, a bottom portion 420, and top portion 430. The top portion 430 is on a side of the cylindrical shape opposite the bottom portion 420. The cupped corrugated cellulosic cushioning element 400 also includes a cavity 440 formed therein with an opening 442 located in the top portion 430. The cupped corrugated cellulosic cushioning element 400 has a U-shape in this embodiment with the bottom portion 420 being rounded.

The side wall 410 includes an inward-facing surface 412 facing the cavity 440 and an outward facing surface 414. Likewise, the bottom portion 420 includes an inward-facing surface 422 facing the cavity 440 and an outward facing surface 424. With the cupped corrugated cellulosic cushioning element 400 being formed from corrugated cellulosic materials (such as single-walled corrugated fiberboard 10 or double-walled corrugated fiberboard 20), the top sheet 12 forms the inward-facing surface 412 of the side wall 410 and the inward-facing surface 422 of the bottom portion 420, and the bottom sheet 14 forms the outward-facing surface 414 of the side wall 410 and the outward-facing surface 424 of the bottom portion 420.

As will be discussed further below, the balled corrugated cellulosic cushioning element 402 shown in FIG. 21B may be formed by taking the cupped corrugated cellulosic cushioning element 400 and further compressing the corrugated cellulosic material to form a ball-like or generally spherical shape. The resulting balled corrugated cellulosic cushioning element 402 may maintain the cavity 440 within the balled corrugated cellulosic cushioning element 402 but the opening 442 is substantially closed.

Figure 22:
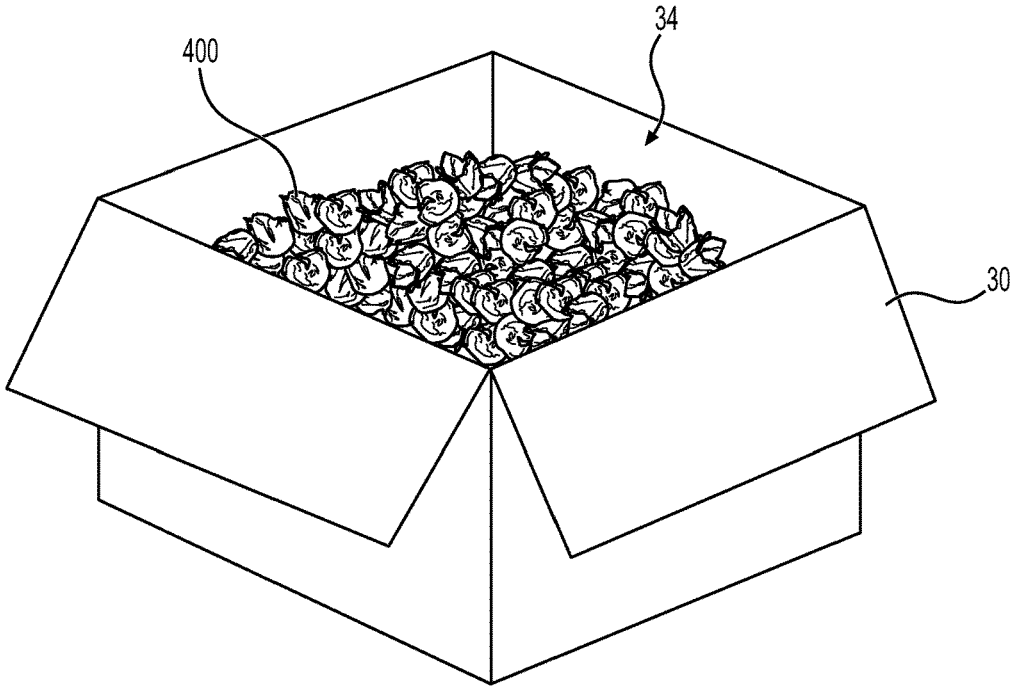
FIG. 22 shows the packing material shown in FIG. 21A used in a shipping box.

The cupped corrugated cellulosic cushioning element 400 and the balled corrugated cellulosic cushioning element 402 may be used on their own as packing material. FIG. 22 shows, for example, a shipping box 30 that has an item-to-be-shipped (e.g., object 32) placed therein. The cupped corrugated cellulosic cushioning element 400 may be placed in the interior 34 of the shipping box 30 to surround the item-to-be-shipped. The cupped corrugated cellulosic cushioning element 400 is elastically deformable to absorb energy and protect the item-to-be-shipped and, even when crushed, provides additional energy (shock) absorption to protect the item-to-be-shipped. Factors impacting the amount of energy absorbed that may be modified for the desired protection include volume or size (e.g., diameter) of the cupped corrugated cellulosic cushioning element 400.

Figure 23:
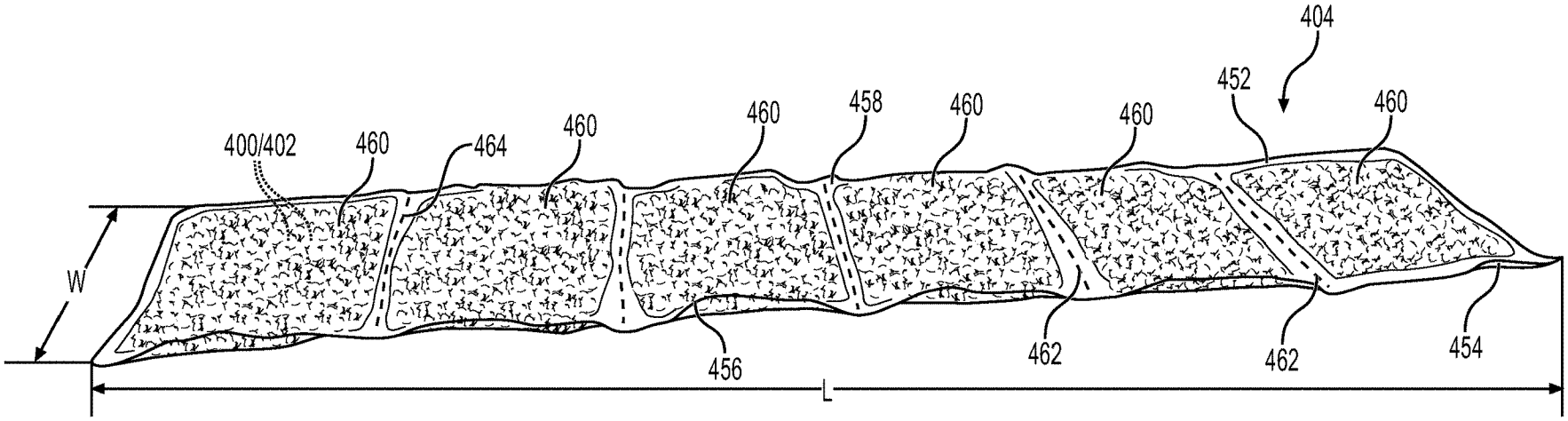
FIG. 23 shows a packing material according to another preferred embodiment of the invention.

The cupped corrugated cellulosic cushioning element 400 and the balled corrugated cellulosic cushioning element 402 also may be used as cushioning elements within various other packing materials. FIG. 23 shows a packing material using the cupped corrugated cellulosic cushioning element 400 or the balled corrugated cellulosic cushioning element 402 as a cushioning element. For clarity with the other packing materials discussed herein, the packing material of this embodiment is referred to as a pillowed packing material 404. The pillowed packing material 404 of this embodiment includes a top sheet 452 and a bottom sheet 454. Although any suitable sheet may be used, the top sheet 452 and the bottom sheet 454 are preferably paper (cellulosic) sheets. The top sheet 452 is connected to the bottom sheet 454 with a plurality of the cupped corrugated cellulosic cushioning element 400 (or balled corrugated cellulosic cushioning element 402) positioned therebetween. The top sheet 452 and the bottom sheet 454 are transparent in FIG. 23 to illustrate the cupped corrugated cellulosic cushioning element 400 located therebetween.

In this embodiment, the pillowed packing material 404 includes a plurality of pockets 460 and a plurality of cupped corrugated cellulosic cushioning elements 400 are located in each pocket 460. The pockets 460 of this embodiment are arrayed in a longitudinal (or length L) direction of the pillowed packing material 404 and in this embodiment include a single row of pockets 460. The pockets 460 of this embodiment are generally rectangular in shape. Each pocket 460 has a pair of first edges and a pair of second edges. The first edges are oriented in the longitudinal direction of the pillowed packing material 404, and the second edges are oriented in a transverse direction (width W direction) of the pillowed packing material 404. Each of the first edges are shorter than each of the second edges. Although described as rectangular pockets 460 arrayed in the longitudinal direction of the pillowed packing material 404, other suitable geometries, sizes, and arrangements may be used.

The pillowed packing material 404 includes a first longitudinal edge 456 and a second longitudinal edge 458. The top sheet 452 is connected to the bottom sheet 454 along each of the first longitudinal edge 456 and the second longitudinal edge 458. The plurality of pockets 460 are formed between the first longitudinal edge 456 and the second longitudinal edge 458, and in this embodiment each pocket 460 extends from the first longitudinal edge 456 to the second longitudinal edge 458. Transverse connecting regions 462 separate adjacent pockets 460 from one another, and in this embodiment, the transverse connecting regions 462 extend from the first longitudinal edge 456 to the second longitudinal edge 458. The top sheet 452 is connected to the bottom sheet 454 in the transverse connecting region 462. In some embodiments, the transverse connecting regions 462 may include a plurality of perforations 464 to allow each pocket 460 to be separated from one another depending upon the desired use of the pillowed packing material 404. The perforations 464 also are oriented in the transverse (width) direction of the pillowed packing material 404.

Figure 24A:
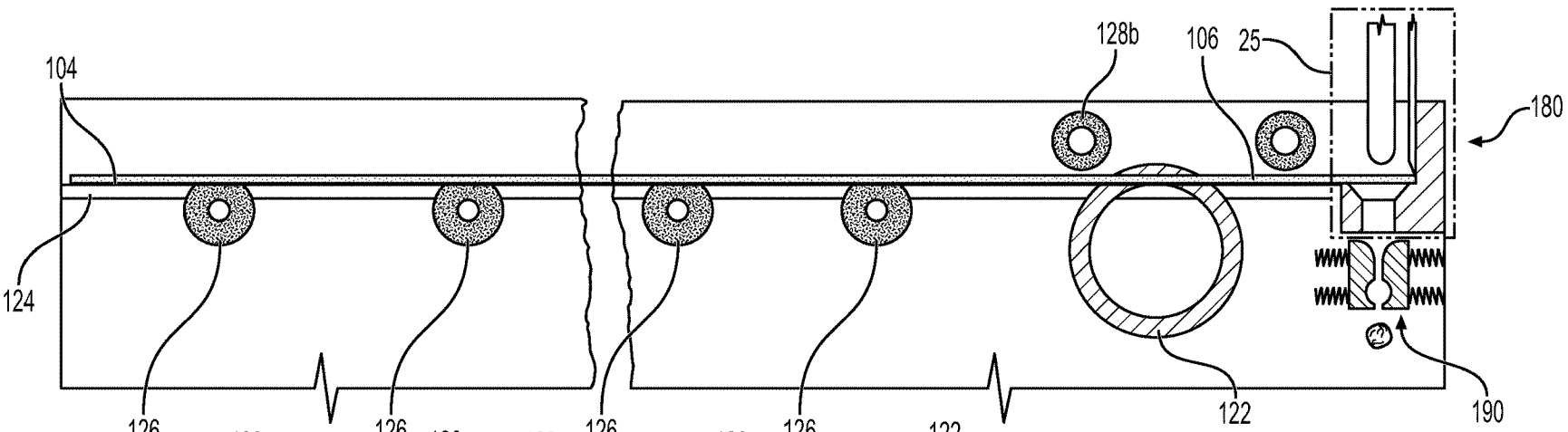
FIGS. 24A and 24B show a conveyor system shown in FIGS. 4A and 4B with an assembly used to form the packing material shown in FIG. 21A or 21B.
Figure 24B:
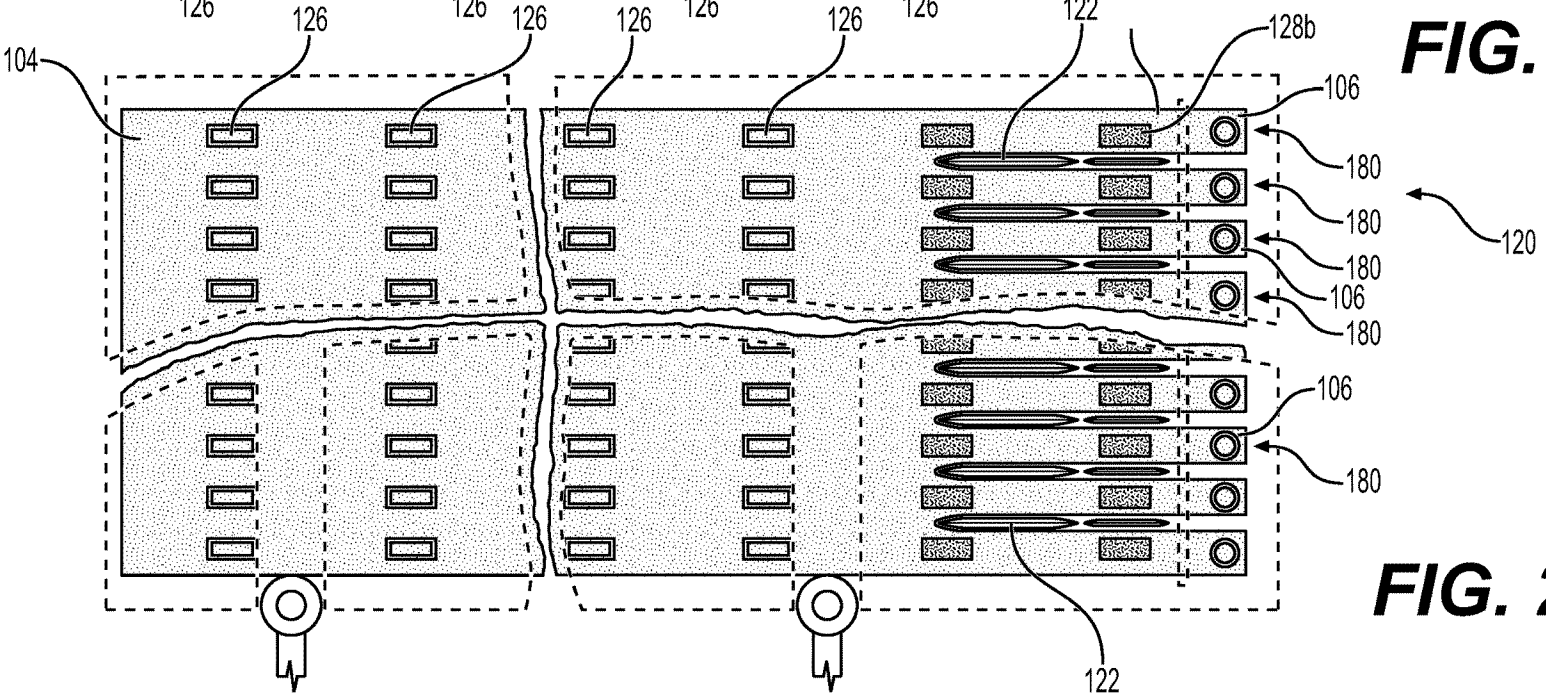
Figure 25:
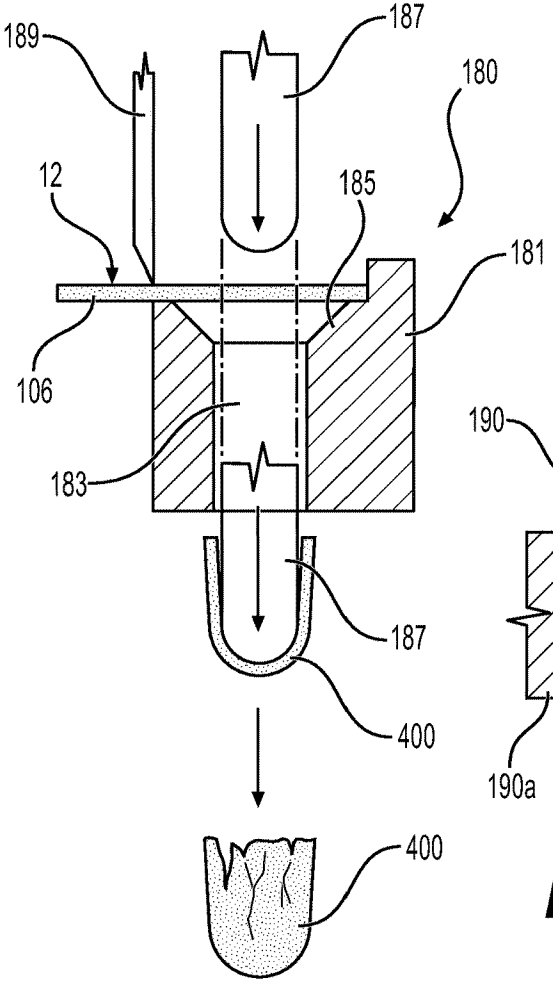
FIG. 25 is a detail view of the assembly, showing detail 25 in FIG. 24A.

FIGS. 24A and 24B show a machine (referred to herein as a punch and die assembly 180) that may be used to form the cupped corrugated cellulosic cushioning element 400 and the balled corrugated cellulosic cushioning element 402 discussed above. The punch and die assembly 180 may be connected to the end of the conveyor system 120 discussed above. FIG. 24A is a side view of the conveyor system 120 with the punch and die assembly 180, and FIG. 44B is a top view of the conveyor system 120 with the punch and die assembly 180. The conveyor system 120 operates as discussed above, and the use of the punch and die assembly 180 to produce the cupped corrugated cellulosic cushioning element 400 will be described with reference to FIG. 25. FIG. 25 is a detail view of the punch and die assembly 180 showing detail 25 in FIG. 24A.

The corrugated stock material strip 106 is fed by the conveyor system 120 on top of a die 181 of the punch and die assembly 180. The die 181 has a cylindrical hole 183 with a taper 185 at the entrance of the die 181 forming a funnel shape. The corrugated stock material strip 106 is pressed through the die 181 with a plunger 187. The plunger 187 has a shape that corresponds to the shape of the die 181. In this embodiment, the plunger 187 is cylindrical with a spherical tip, but any suitable shape may be used. The cylindrical hole 183 of the die 181 has a diameter, and the diameter of the plunger 187 is smaller than the diameter of the cylindrical hole 183 so that the plunger 187 can be inserted into the cylindrical hole 183. The plunger 187 is lowered to press the corrugated stock material strip 106 in the thickness direction of the corrugated stock material strip 106. The tip of the plunger 187 contacts the top sheet 12 of the corrugated stock material strip 106 and pushes the corrugated stock material strip 106 into the cylindrical hole 183 of the die 181. The corrugated stock material strip 106 has a surface area that is greater than the surface area of the cylindrical hole 183 at the exit of the die 181. As the plunger 187 pushes (presses) the corrugated stock material strip 106 into the taper 185 and the cylindrical hole 183 of the die 181, the corrugated stock material strip 106 conforms to the shape of the die 181 and the plunger 187 to form the cupped corrugated cellulosic cushioning element 400. The plunger 187 is inserted into the cylindrical hole 183 of the die 181 such that the plunger 187 discharges the cupped corrugated cellulosic cushioning element 400 from the exit (bottom) of the die 181.

When the corrugated stock material strip 106 is longer than desired to form the cupped corrugated cellulosic cushioning element 400, the punch and die assembly 180 also includes a cutter 189 that is to cut the corrugated stock material strip 106 to the appropriate length. In this embodiment, the cutter 189 is configured to move with the plunger 187 between the top of the die 181 and the support surface 124 (see FIG. 24A). The cutter 189 cuts the corrugated stock material strip 106 just before or as the tip of the plunger 187 contacts the top sheet 12 of the corrugated stock material strip 106 to push the corrugated stock material strip 106 into the die 181.

To form the balled corrugated cellulosic cushioning element 402, the cupped corrugated cellulosic cushioning element 400 is compressed after being formed as described above. The punch and die assembly 180 may thus include a form (or a mold) 190 used to compress the cupped corrugated cellulosic cushioning element 400 within a cavity 192. The form 190 may include a first portion 190*a* and a second portion 190*b*. Each of the first portion 190*a* and the second portion 190*b* of the form 190 has a concavity formed therein that, when the first portion 190*a* and the second portion 190*b* are brought together, form a spherical cavity 192. In this embodiment each concavity is hemispherical to form the cavity 192.

Figure 26C:
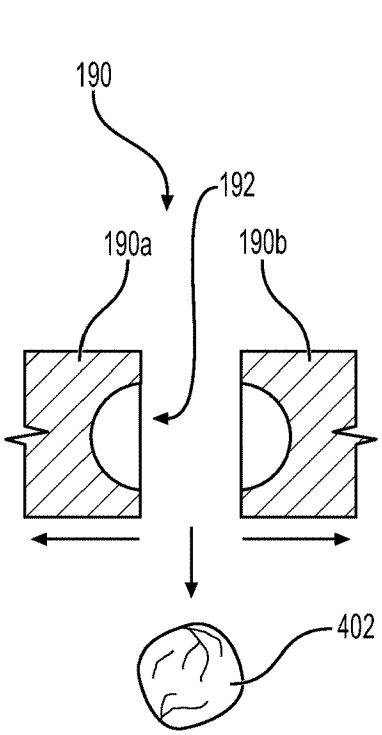
FIGS. 26A to 26C illustrate a process of forming the packing material shown in FIG. 21B.
Figure 26B:
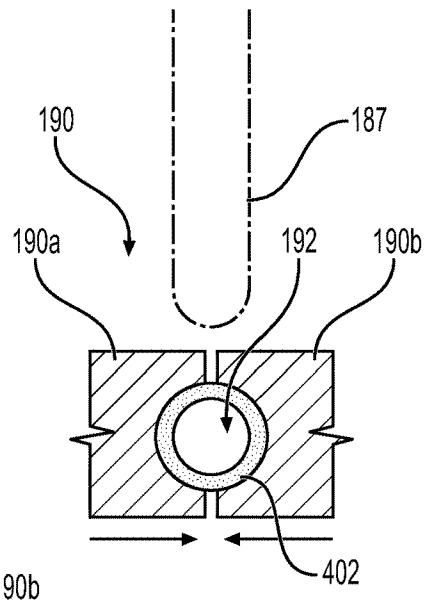
Figure 26A:
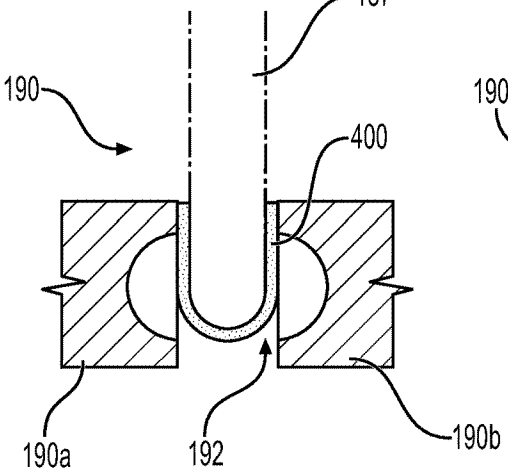

FIGS. 26A to 26C illustrate the process of forming the balled corrugated cellulosic cushioning element 402. FIG. 26A shows a first step. Instead of ejecting the cupped corrugated cellulosic cushioning element 400 (illustrated in FIG. 25), the plunger 187 positions, in the first step, the cupped corrugated cellulosic cushioning element 400 between the first portion 190*a* and the second portion 190*b* of the form 190 with the first portion 190*a* and the second portion 190*b* spaced apart from each other. FIG. 26B shows a second step. In the second step, the plunger 187 is retracted and the first portion 190*a* and the second portion 190*b* are brought together to compress the cupped corrugated cellulosic cushioning element 400 within the cavity 192 forming the balled corrugated cellulosic cushioning element 402. FIG. 26C shows a third step. In the third step, the first portion 190*a* and the second portion 190*b* are moved away from each other to eject the balled corrugated cellulosic cushioning element 402 from the form 190.

Figures 27A, 27B, 27C:
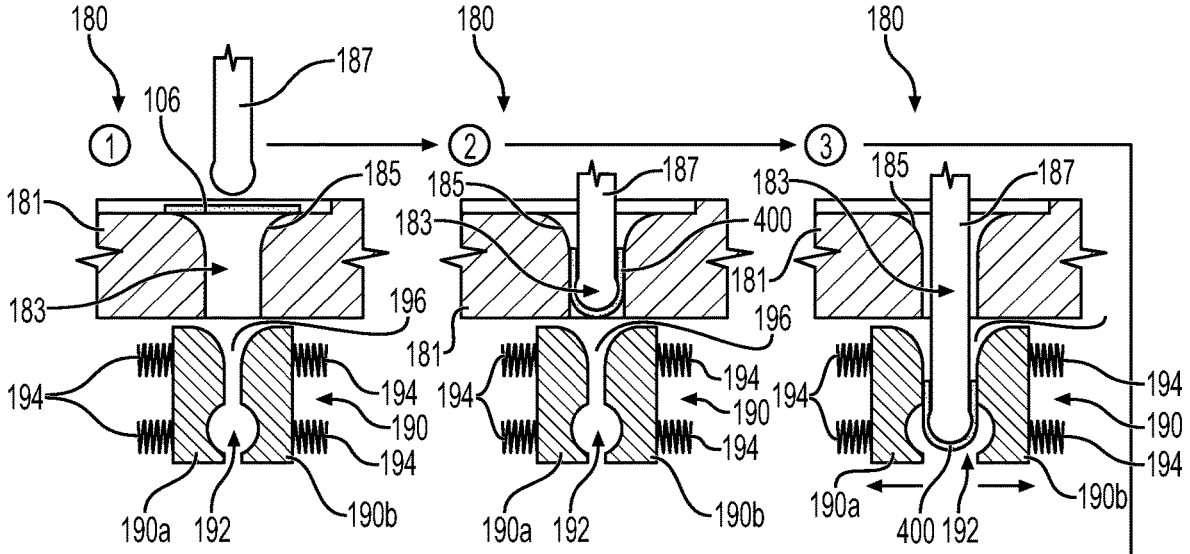
FIGS. 27A to 27F illustrate a variation of the process of forming the packing material shown in FIG. 21B.

FIGS. 27A to 27F illustrate a variation on this process. FIGS. 27A to 27F show a first through sixth steps of the process, respectively. The corrugated stock material strip 106 is placed on top of the die 181 in the first step shown in FIG. 27A. A second step is shown in FIG. 27B. In the second step, the plunger 187 presses the corrugated stock material strip 106 through the die 181 to form the cupped corrugated cellulosic cushioning element 400 as described above with reference to FIG. 25. The form 190 of this embodiment includes biasing members 194, such as a spring, to press the first portion 190*a* and the second portion 190*b* of the form 190 together. The form 190 also includes a taper 196 forming a funnel shape at the upper portion of the form 190.

FIG. 27C shows a third step, which includes placing the balled corrugated cellulosic cushioning element 402 in the form 190 in the manner described above with reference to FIG. 26A. After the plunger 187 presses the cupped corrugated cellulosic cushioning element 400 through the cylindrical hole 183, the plunger 187 and the cupped corrugated cellulosic cushioning element 400 contact the taper 196 of the form 190 pushing the first portion 190*a* and the second portion 190*b* away from each other against the biasing force (spring force) of the biasing members 194.

Figures 27D, 27E, 27F:
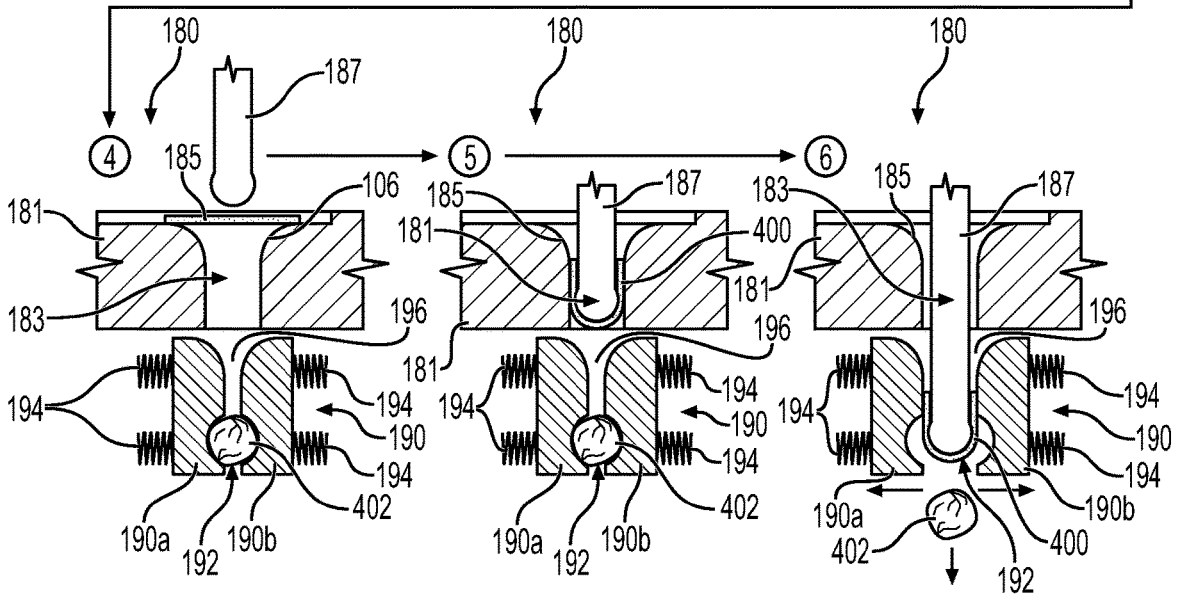

FIG. 27D illustrates a fourth step, where the plunger 187 is withdrawn back to the position in the first step (FIG. 27A). With the plunger 187 withdrawn from between the first portion 190*a* and the second portion 190*b* of the form 190, the biasing force of the biasing members 194 presses the first portion 190*a* and the second portion 190*b* of the form 190 together to compress the cupped corrugated cellulosic cushioning element 400 and form the balled corrugated cellulosic cushioning element 402 as described above with reference to FIG. 26B. The form 190 maintains the balled corrugated cellulosic cushioning element 402 within the cavity 192 while the next cupped corrugated cellulosic cushioning element 400 is formed, as illustrated in the fifth step shown in FIG. 27E. Then, when the plunger 187 places the next cupped corrugated cellulosic cushioning element 400 in the form 190 as described above, the movement of the first portion 190*a* and the second portion 190*b* against the biasing force of the biasing members 194 ejects the balled corrugated cellulosic cushioning element 402, as illustrated in the fifth step shown in FIG. 27F.

Figure 28A:
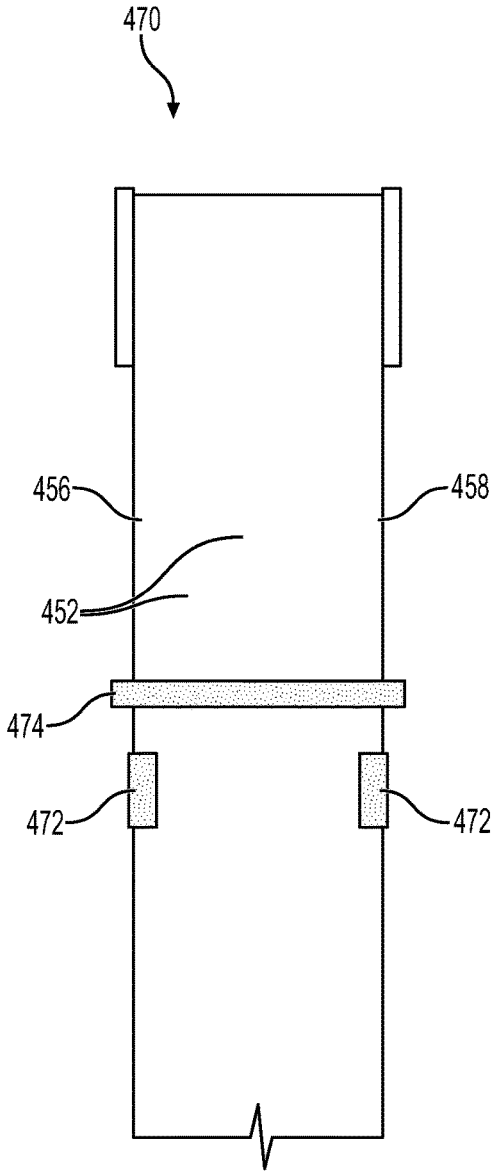
FIGS. 28A and 28B illustrate a machine and process of forming the packing material shown in FIG. 23.
Figure 28B:
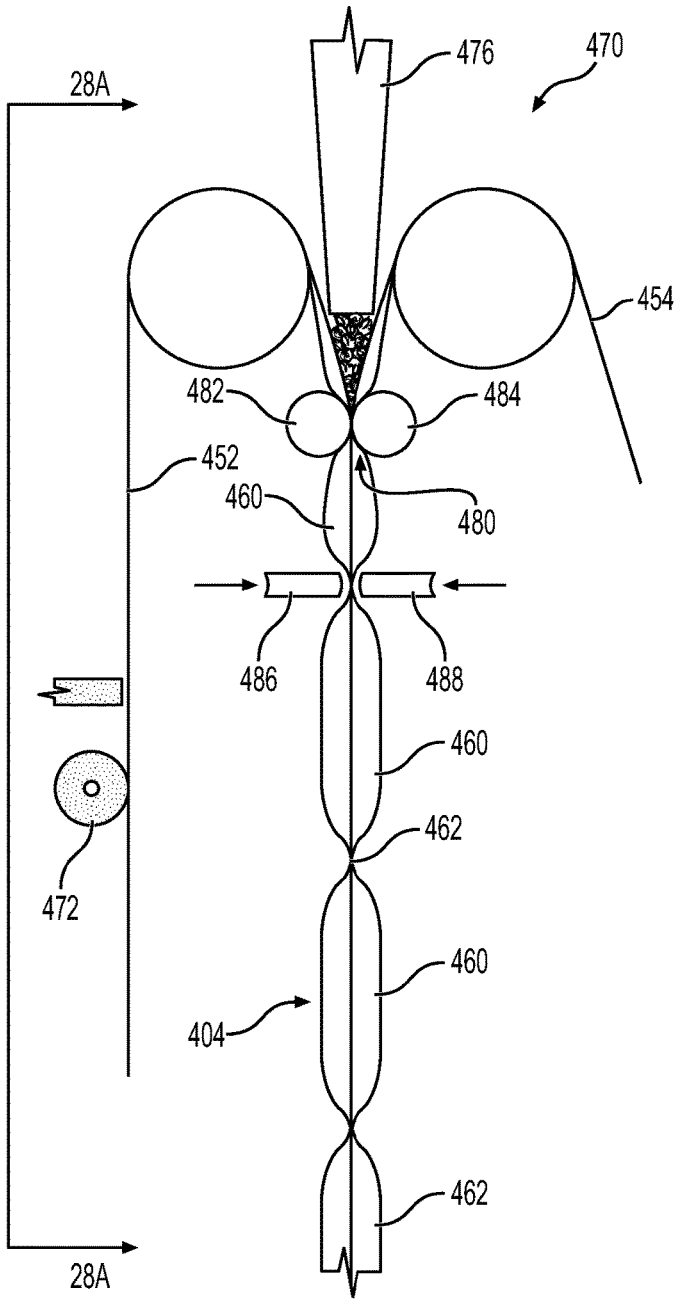

FIGS. 28A and 28B illustrate a machine 470 and process of forming the pillowed packing material 404. FIG. 28A is the side view indicated in FIG. 28B. The top sheet 452 and the bottom sheet 454 are attached to each other by an adhesive, and the machine 470 includes two edge adhesive applicators 472 that continuously apply the adhesive to the first longitudinal edge 456 and the second longitudinal edge 458 of the top sheet 452. The edge adhesive applicators 472 in this embodiment are rollers that continuously apply the adhesive. The machine 470 also includes a transverse adhesive applicator 474 that applies an adhesive transversely across the width of the top sheet 452. The transverse adhesive applicator 474 periodically applies the adhesive to the top sheet 452 and this adhesive will be used to form the transverse connecting regions 462.

The top sheet 452 and the bottom sheet 454 are brought together with the first longitudinal edge 456 and the second longitudinal edge 458 of each of the top sheet 452 and the bottom sheet 454 in a nip 480 formed between a first roller 482 and a second roller 484. The first roller 482 and the second roller 484 press the top sheet 452 and the bottom sheet 454 together to form the first longitudinal edge 456 and the second longitudinal edge 458. The machine 470 also includes a first pressing bar 486 and a second pressing bar 488 that are positioned opposite each other on either side of the top sheet 452 and the second longitudinal edge 458. The first pressing bar 486 and the second pressing bar 488 are brought together at an interval and location that corresponds to the adhesive applied by the transverse adhesive applicator 474. The first pressing bar 486 and the second pressing bar 488 apply a compressive force to the width of the top sheet 452 and the bottom sheet 454 to form the transverse connecting regions 462. The first pressing bar 486 and the second pressing bar 488 may include features, such as protrusions, that form the perforations 464, or such perforations 464 may be formed separately at a subsequent step.

The machine 470 also includes a dispenser 476. The dispenser 476 may be a chute that is configured to periodically release the cupped corrugated cellulosic cushioning element 400 or the balled corrugated cellulosic cushioning element 402 into the pockets 460 that is being formed above the first pressing bar 486 and the second pressing bar 488 and below the first roller 482 and the second roller 484. When a desired amount of the cupped corrugated cellulosic cushioning element 400 or the balled corrugated cellulosic cushioning element 402 has been placed in the pockets 460, the dispenser 476 is stopped and the top sheet 452 and the bottom sheet 454 are advanced to a position where the first pressing bar 486 and the second pressing bar 488 press against each other to form the transverse connecting regions 462 and seal the pocket 460.

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. A method of packing an object in a shipping box, the method comprising:

providing a shipping box including an interior with an object placed in the interior of the shipping box;

maintaining a packing material in a compressed state by applying a compression force in a longitudinal direction of the packing material, the packing material being a strip of corrugated cellulosic material including a plurality of macro flutes, each macro flute being oriented in a transverse direction that is transverse to the longitudinal direction of the packing material, wherein the corrugated cellulosic material includes at least one corrugated cellulosic sheet with a plurality of interior flutes;

placing the packing material in the compressed state into a space formed between the object and the shipping box; and releasing the compression force and allowing the packing material to expand to an expanded state, the length of the strip of corrugated cellulosic material being longer in the expanded state than the compressed state.

2. The method of claim 1, further comprising:

providing the shipping box; and placing the object into the interior of the shipping box.

3. The method of claim 1, wherein each macro flute includes a first planar surface connected to a second planar surface at a peak, the first planar surface and the second planar surface forming an included angle therebetween, and the included angle, when the strip of corrugated cellulosic material is in the compressed state, is less than the included angle when the strip of corrugated cellulosic material is in the expanded state.

4. The method of claim 1, further comprising removing the packing material from a holder configured to hold a plurality of the packing materials in the compressed state.

5. The method of claim 4, further comprising:

compressing the packing material from a fully expanded state to the compressed state; and placing the packing material in the compressed state into a compartment of the holder.

6. The method of claim 5, wherein the holder includes a plurality of compartments, each compartment of the plurality of compartments being sized to hold the packing material in the compressed state.

7. The method of claim 1, wherein the expanded state is an intermediate expanded state, and the packing material having a fully expanded state, the length of the strip of corrugated cellulosic material being longer in the fully expanded state than the intermediate expanded state.

8. The method of claim 1, wherein releasing the compression force allows the packing material to expand to in the longitudinal direction of the packing material.

9. The method of claim 1, wherein each macro flute includes a first planar surface connected to a second planar surface at a peak, the first planar surface and the second planar surface form an included angle therebetween, and the included angle, when the strip of corrugated cellulosic material is in the compressed state, is less than the included angle when the strip of corrugated cellulosic material is in the expanded state.

10. The method of claim 1, wherein each macro flute includes a first planar surface connected to a second planar surface at a peak, wherein the first planar surface of one macro flute is configured to abut the second planar surface of an adjacent macro flute when the strip of corrugated cellulosic material is in the compressed state.

11. The method of claim 1, wherein the macro flutes are parallel to each other.

12. The method of claim 1, wherein each macro flute is oriented in a direction parallel to the interior flutes of the corrugated cellulosic sheet.

13. A method of preparing a packing material for use in packing an object in a shipping box, the method comprising:

compressing a packing material in a longitudinal direction from a fully expanded state to a compressed state, the packing material being a strip of corrugated cellulosic material including a plurality of macro flutes, each macro flute being oriented in a transverse direction that is transverse to the longitudinal direction of the packing material, wherein the corrugated cellulosic material includes at least one corrugated cellulosic sheet with a plurality of interior flutes, the length of the strip of corrugated cellulosic material being longer in the fully expanded state than the compressed state; and placing the packing material in the compressed state into a holder configured to hold the packing material in the compressed state.

14. The method of claim 13, wherein the holder includes one or more compartments and placing the packing material into a holder includes placing the packing material in the compressed state into a compartment of the holder.

15. The method of claim 14, wherein the compartment is sized to hold the packing material in the compressed state.

16. The method of claim 13, further comprising forming the packing material from a strip of corrugated cellulosic material.

17. The method of claim 16, wherein forming the packing material includes cutting corrugated stock material to form the strip of corrugated cellulosic material.

18. The method of claim 17, wherein the corrugated stock material is unfolded scrap shipping box.

19. The method of claim 17, wherein the corrugated stock material is sized corrugated stock material and forming the packing material further includes cutting an unfolded scrap shipping box to form the sized corrugated stock material.

20. A method of packing an object in a shipping box, the method comprising:

forming a packing material from a strip of corrugated cellulosic material, the packing material having a longitudinal direction and including a plurality of macro flutes, each macro flute being oriented in a transverse direction that is transverse to the longitudinal direction of the packing material, wherein the corrugated cellulosic material includes at least one corrugated cellulosic sheet with a plurality of interior flutes;

compressing the packing material from a fully expanded state to a compressed state, the length of the strip of corrugated cellulosic material being longer in the fully expanded state than the compressed state;

placing the packing material in the compressed state into a holder configured to hold the packing material in the compressed state;

removing the packing material from the holder;

providing a shipping box including an interior with an object placed in the interior of the shipping box;

maintaining a packing material in a compressed state by applying a compression force in the longitudinal direction of the packing material;

placing the packing material in the compressed state into a space formed between the object and the shipping box; and releasing the compression force and allowing the packing material to expand to an expanded state, the length of the strip of corrugated cellulosic material being longer in the expanded state than the compressed state.

* * * * *